US009989262B2

(12) United States Patent
Tyler et al.

(10) Patent No.: US 9,989,262 B2
(45) Date of Patent: Jun. 5, 2018

(54) APPLIANCE THERMAL MANAGEMENT SYSTEMS

(71) Applicant: Owens Corning Intellectual Capital, LLC, Toledo, OH (US)

(72) Inventors: Francis Sidney Tyler, Westerville, OH (US); Manoj Choudhary, Reynoldsburg, OH (US); Larry John Grant, Westerville, OH (US); William Kunkler, Heath, OH (US); Robert P. Collier, Gahanna, OH (US); A. Lee Miller, Newark, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 490 days.

(21) Appl. No.: 14/213,456

(22) Filed: Mar. 14, 2014

(65) Prior Publication Data

US 2014/0261369 A1 Sep. 18, 2014

Related U.S. Application Data

(60) Provisional application No. 61/794,131, filed on Mar. 15, 2013.

(51) Int. Cl.
*F24C 15/00* (2006.01)
*F24C 15/34* (2006.01)

(52) U.S. Cl.
CPC ..... *F24C 15/34* (2013.01)

(58) Field of Classification Search
CPC .. F24C 15/34; E04C 2003/0473; E04C 2/296; B65D 57/00; B65D 90/004
See application file for complete search history.

(56) References Cited

U.S. PATENT DOCUMENTS

| | | | | |
|---|---|---|---|---|
| 737,331 | A * | 8/1903 | Felton | E06B 3/4654 49/228 |
| 4,597,702 | A * | 7/1986 | Brown | F16B 21/09 24/103 |
| 6,337,143 | B1 | 1/2002 | Ragland et al. | |
| 6,877,291 | B2 * | 4/2005 | Shamroukh | E04B 7/022 403/232.1 |
| 7,814,896 | B2 | 10/2010 | Chacko et al. | |
| 8,402,961 | B2 | 3/2013 | Choudhary et al. | |
| 8,763,847 | B2 | 7/2014 | Mortarotti | |
| 2008/0246379 | A1 | 10/2008 | Choudhary | |
| 2009/0114209 | A1 * | 5/2009 | Moller | F16L 3/1041 126/569 |
| 2012/0017883 | A1 * | 1/2012 | Campen | F24C 15/34 126/19 R |

(Continued)

OTHER PUBLICATIONS

McElroy et al. "Development of Advanced Thermal Insulation for Appliances", Jul. 1984, 75 pgs.

*Primary Examiner* — Jason Lau
(74) *Attorney, Agent, or Firm* — Calfee, Halter & Griswold LLP

(57) ABSTRACT

A thermal appliance is provided. The thermal appliance includes a heating compartment inside of an enclosure, with insulation disposed between the heating compartment and enclosure. Retainers or standoffs are also included in the thermal appliance to prevent air gaps from forming between the insulation and the heating compartment, and to prevent the insulation from making contact with the enclosure.

31 Claims, 44 Drawing Sheets

(56) References Cited

U.S. PATENT DOCUMENTS

| | | | |
|---|---|---|---|
| 2013/0084445 | A1 | 4/2013 | Haley et al. |
| 2013/0266784 | A1 | 10/2013 | Haley et al. |
| 2013/0292371 | A1 | 11/2013 | Braden et al. |

* cited by examiner

APPLIANCE THERMAL MANAGEMENT SYSTEMS

RELATED APPLICATIONS

The present application claims the benefit of U.S. Provisional Patent Application Ser. No. 61/794,131, filed on Mar. 15, 2013, titled "Appliance Thermal Management Systems." U.S. Provisional Patent Application Ser. No. 61/794,131 is incorporated herein by reference in its entirety.

TECHNICAL FIELD

This invention relates generally to thermal management systems for controlling the temperature of a heating appliance, such as a thermal oven or a thermal hot water heater, and more specifically relates to controlling the temperature of localized "hot spots" within the heating appliance.

BACKGROUND

Thermal appliances, such as for example ovens and hot water heaters use high heat levels for various purposes, including food preparation, self-cleaning, and heating of water. The high heat levels are produced within a heating compartment or a heating tank, which is also the location of the food being prepared, or the interior surfaces being self-cleaned, or the water being heated. Various energy sources, including natural gas, electricity, and oil can be used to produce the high heat levels. The heating compartment or heating tank is typically positioned within a cabinet or a cylindrical enclosure. The cabinet or cylindrical enclosure typically includes side panels, a back panel, a top panel and a bottom panel. High temperature insulation can be positioned adjacent to the sides, top, back, and bottom of the heating compartment or heating tank. The high temperature insulation is used to control the flow of heat from the sides, top, and bottom of the heating compartment or heating tank to the outside of the enclosure or cabinet. The temperature within the heating compartment or heating tank during normal operation can reach up to 1600 degrees F. (871 degrees C.).

Numerous consumer safety codes have been enacted which relate to the maximum allowable external temperature of the enclosure or cabinet. Since some thermal appliances, such as thermal ovens, are typically positioned adjacent other fixtures, such as for example other appliances, or are built-in next to wood-based cabinets, the enclosure or cabinet can be very close to or in direct contact with these other fixtures. Additionally, surface temperature limits may be designed around possible exposure to human touch.'

SUMMARY

In a thermal appliance embodying the principles of the invention, retainers or standoffs are used to eliminate the formation of hotspots on the exterior of the appliance enclosure. The appliance includes a heating compartment within the enclosure that is surrounded by insulation. The retainers or standoffs are positioned between the enclosure and heating compartment to keep the insulation in continuous contact with the heating compartment such that no air gaps are formed between the insulation and the heating compartment. The retainers or standoffs also prevent the insulation from making contact with the enclosure. By eliminating the air gaps and contact between the insulation and enclosure, hot spots on the exterior of the enclosure due to air heated in the gap and contact between the insulation and enclosure are reduced or eliminated.

DETAILED DESCRIPTION

The description and drawings disclose an thermal management systems for thermal appliances. A thermal appliance is defined as an apparatus or structure for heating an object positioned within the appliance. Various examples of thermal appliances include traditional residential ovens, commercial ovens, convection ovens, microwave ovens, hot water heaters or any other apparatus or structure sufficient to heat an object positioned within the appliance.

Figure 1:
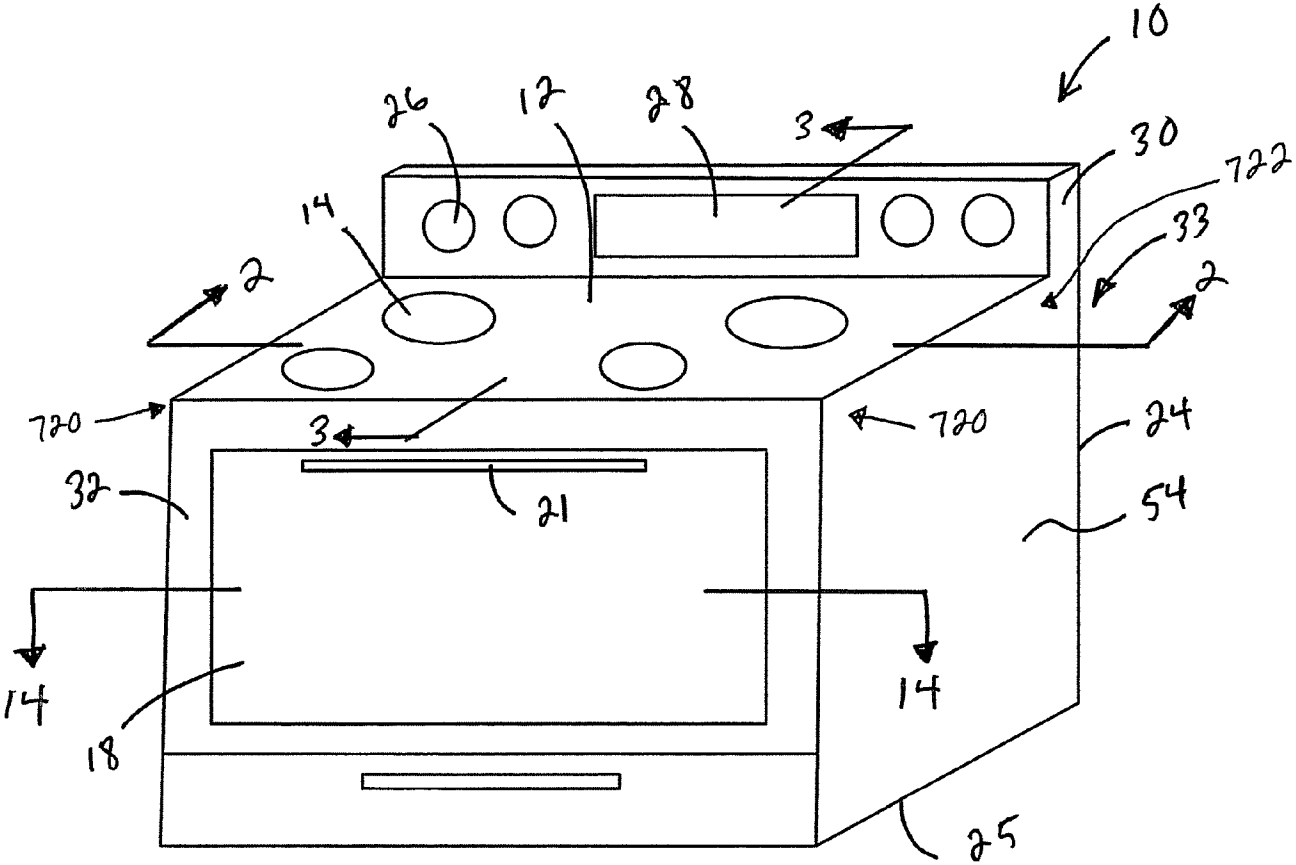
FIG. 1 is a perspective view of a thermal oven.

Referring now to the drawings, there is shown in FIG. 1 one example of a thermal appliance, namely a thermal oven 10. The thermal oven 10 includes a substantially flat, top cooking surface 12. A plurality of heating elements or burners 14 are typically positioned on the top cooking surface 12, although the heating elements or burners 14 are optional. The thermal oven 10 includes a plurality of controls 26 for the burners 14 on the cooking surface as well as a control panel 28 for controlling the temperature within an oven cavity 16. Typically, the controls 26 and control panel 28 are mounted on a backsplash 30. The backsplash 30 is located on a back edge of the cooking surface 12. The backsplash 30 typically extends away from, and substantially perpendicular to, the cooking surface 12.

Figure 2:
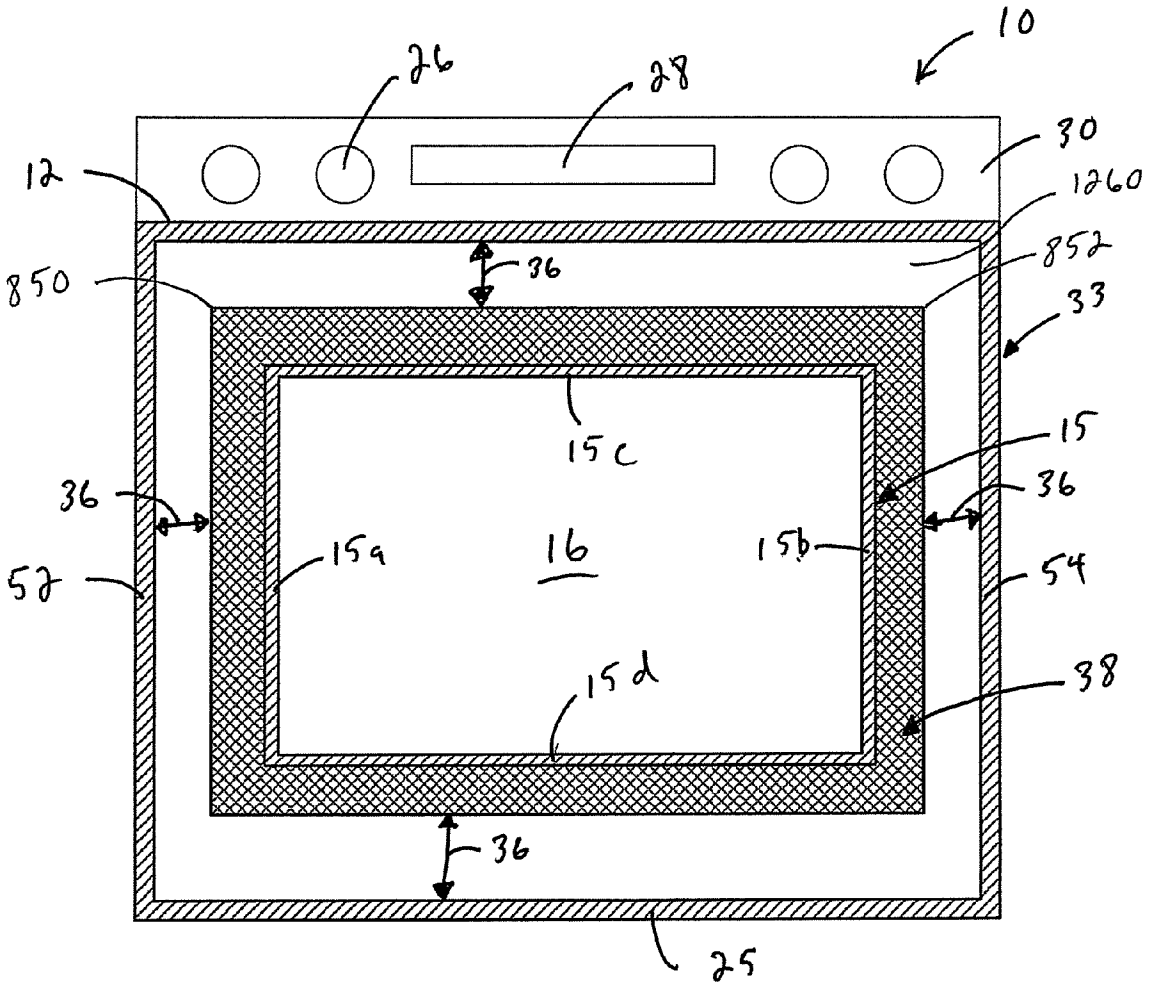
FIG. 2 is a cross-sectional view taken along the plane indicated by lines 2-2 in FIG. 1 illustrating an oven cavity.
Figure 3:
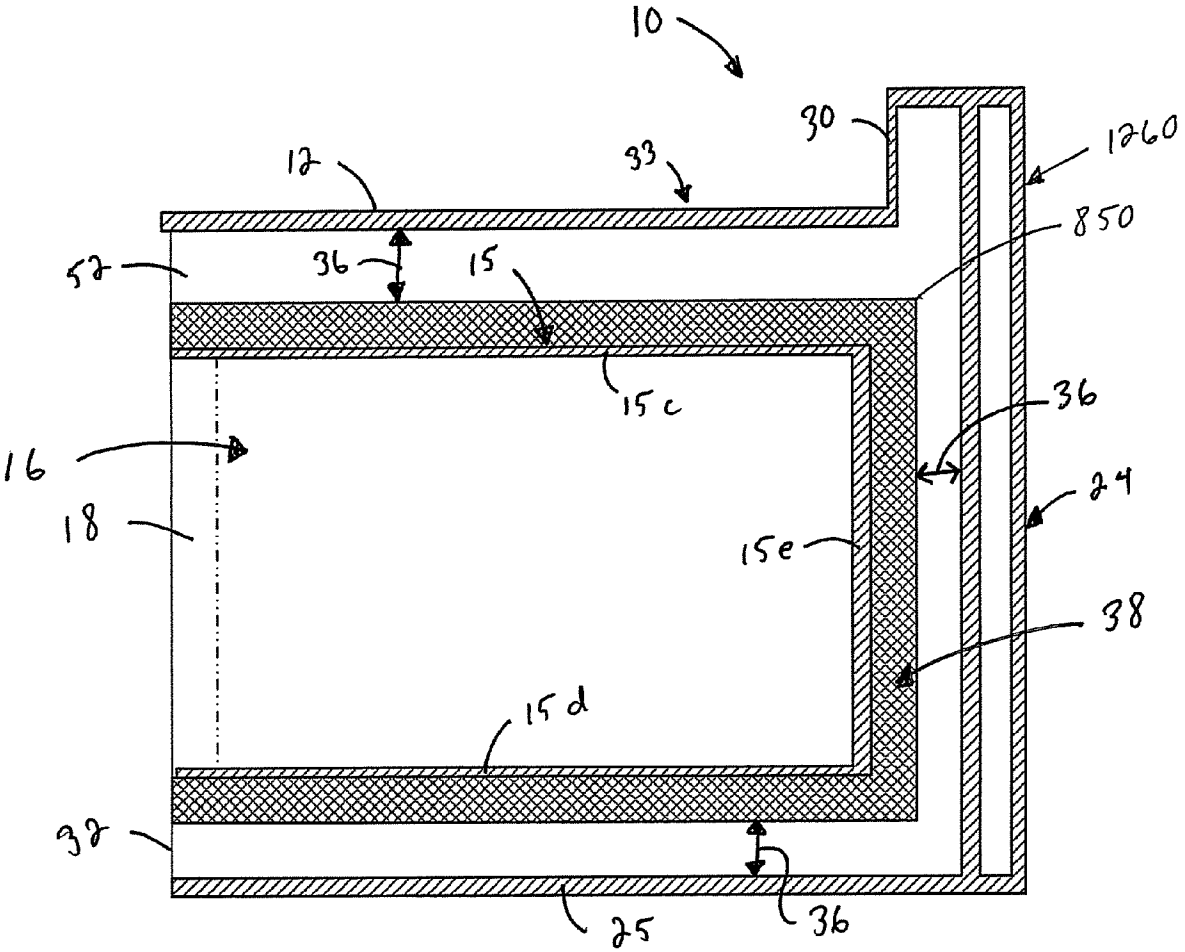
FIG. 3 is a cross-sectional view taken along the plane indicated by lines 3-3 in FIG. 1.

As shown in FIGS. 1-3, the thermal oven 10 includes a pair of opposed side panels 52 and 54, a back panel 24, a bottom panel 25, and a front panel 32. The opposed side panels 52 and 54, back panel 24, bottom panel 25, front panel 32 and cooking surface 12 are configured to form an outer oven cabinet 33. The outer oven cabinet 33 is typically finished with an aesthetically pleasing finish, such as for example a painted finish, a porcelain enamel finish or a brushed stainless steel finish, particularly for those panels that are exposed to view by consumers.

The front panel 32 includes an insulated oven door 18 pivotally connected to the front panel 32. The oven door 18 is hinged at a lower end to the front panel 32 such that the oven door can be pivoted away from the front panel 32 and the oven cavity 16. Optionally, the oven door 18 can include a window. The window is typically made of glass, in order that the user can view the contents of the oven cavity 16 during its use. Also, the oven door 18 can include a handle 21 configured to facilitate moving the oven door 18 from an open position to a closed position and vice versa.

As shown in FIGS. 2 and 3, the outer oven cabinet 33 supports an inner oven liner 15. The inner oven liner 15 includes opposing liner sides 15*a* and 15*b*, a liner top 15*c*, a liner bottom 15*d* and a liner back 15*e*. The opposing liner sides 15*a* and 15*b*, liner top 15*c*, liner bottom 15*d*, liner back 15*e* and oven door 18 are configured to define the oven cavity 16.

As further shown in FIGS. 2 and 3, the exterior of the oven liner 15 is covered by insulation material 38. A typical insulation material 38 is fiberglass insulation, although other insulation material 38 can be used. In one exemplary embodiment, the insulation material 38 is a binderless or dry binder fiberglass insulation material. For example, the fiberglass insulation material may be any of the insulation materials and/or may be formed by any of the processes described in U.S. patent application Ser. No. 13/632,895, titled "METHOD FOR FORMING A WEB FROM FIBROUS MATERIAL," filed on Oct. 1, 2013 and U.S. patent application Ser. No. 13/839,350, titled "METHOD FOR FORMING A WEB FROM FIBROUS MATERIAL," filed on Mar. 15, 2013, and which is a continuation-in-part of U.S. patent application Ser. No. 13/632,895, both of which are incorporated herein by reference in their entirety. The insulation material 38 typically has a density within the range from about 0.5 lbs/ft.sup.3 (8 kg/m.sup.3) to about 10.0 lbs/ft.sup.3 (160 kg/m.sup.3), and a thickness within the range from about 1.0 inches (2.54 cm) to about 3 inches (7.62 cm). In other embodiments, the insulation material 38 may have a thickness that is less than 1 inch. For example, the insulation may be ¼" to ¾" thick. The insulation material 38 is placed in contact with an outside surface of the oven liner 15.

The insulation material 38 is used for many purposes, including retaining heat within the oven cavity 16 and limiting the amount of heat that is transferred from the heated cavity to the exterior of the appliance by conduction, convection and radiation to the outer oven cabinet 33. The thermal insulation systems disclosed by this application are composite systems that are multi-dynamic.

As shown in FIGS. 2 and 3, an air gap 36 is formed between the insulation material 38 and the outer oven cabinet 33. The air gap 36 is used as a further insulator to limit the conductive heat transfer between oven liner 15 and the outer oven cabinet 33. The use of the air gap 36 supplements the insulation material 38 to minimize the surface temperatures on the outer surfaces of the outer oven cabinet 33.

During normal cooking operation, the thermal oven 10 will heat the oven cavity 16 to a cooking temperature range from about 250.degree. F. (121.degree. C.) to about 500.degree. F. (260.degree. C.). When operating in a self-cleaning mode, the thermal oven 10 heats the oven cavity 16 to a temperature in a range from about 750.degree. F. (398.degree. C.) to about 900.degree. F. (482.degree. C.). For commercial or industrial thermal ovens, the temperature within the oven cavity 116 can reach as high as 1600.degree. F. (871.degree. C.). Heat exposure tests, such as the UL858 Standard for Household Electric Ranges and ANSI Z21.1 Standard for Household Cooking Gas Appliances, require that the maximum allowable surface temperature be 152.degree. F. for a painted metal surface, 160.degree. F. for a porcelain enamel surface, or 172.degree. F. for a glass surface. These temperatures are for surfaces that are visible (i.e. not covered or concealed by cabinetry) after installation of the appliance.

Figure 4:
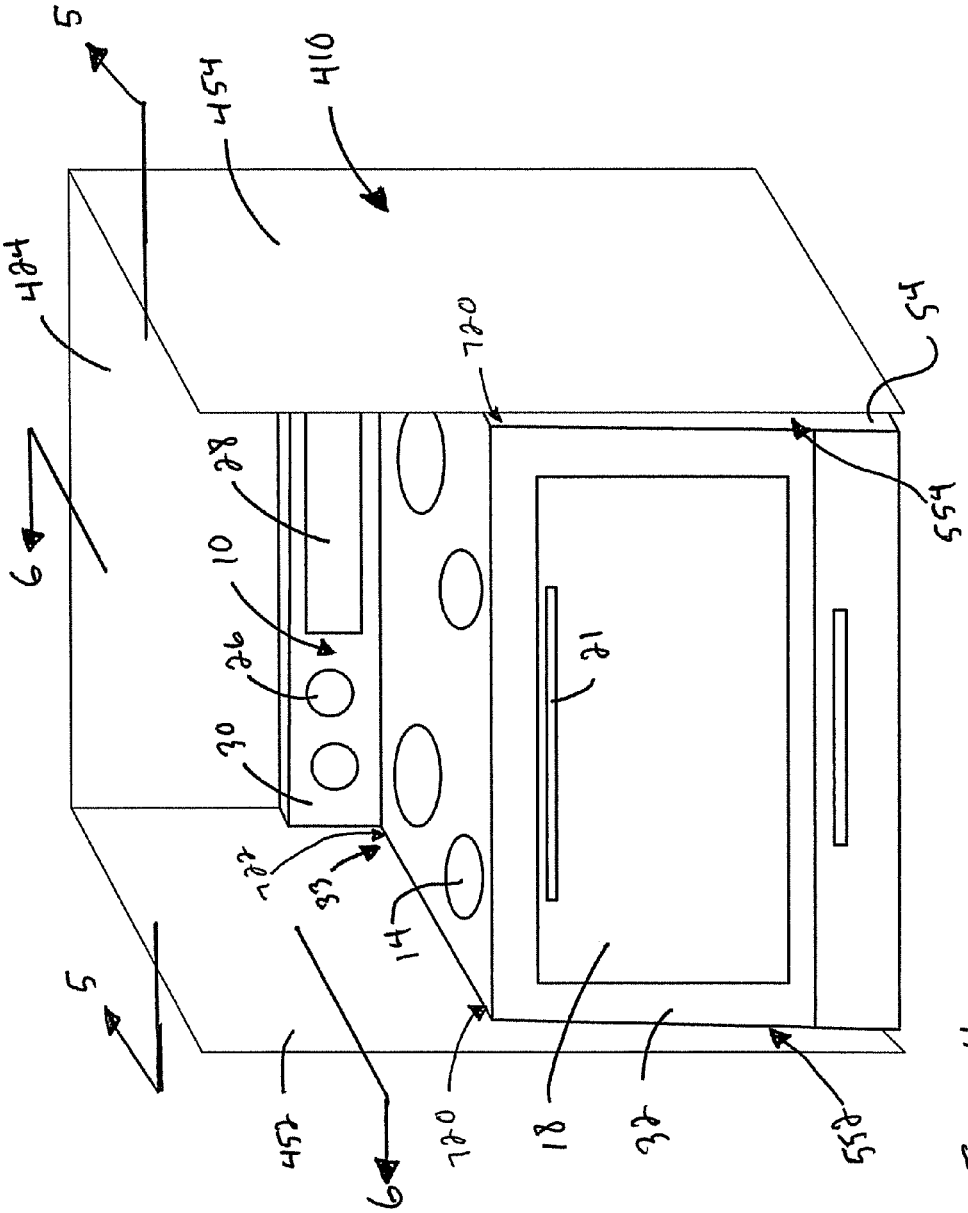
FIG. 4 is a perspective view of a thermal oven in a thermal test fixture.
Figure 5:
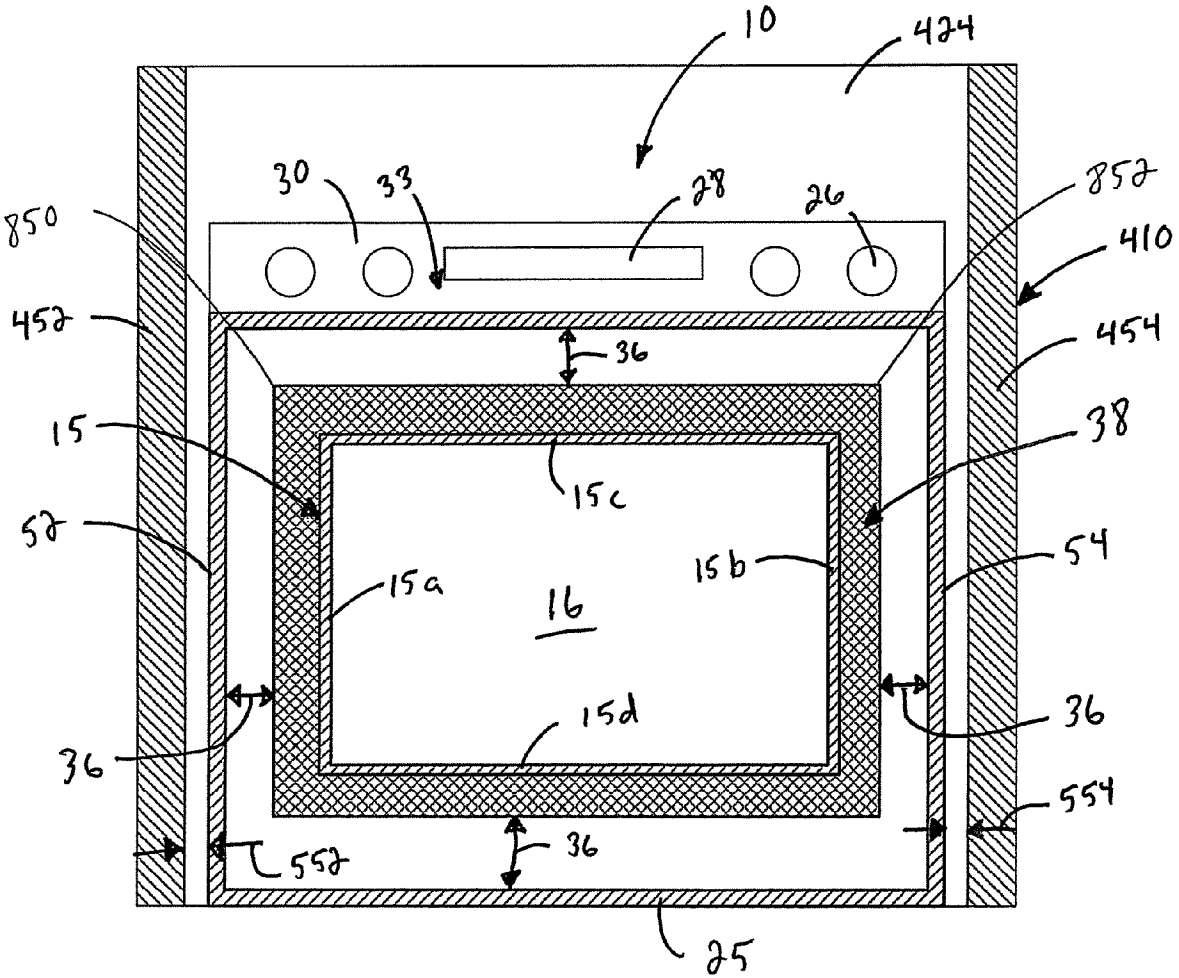
FIG. 5 is a cross-sectional view taken along the plane indicated by lines 5-5 in FIG. 4.
Figure 6:
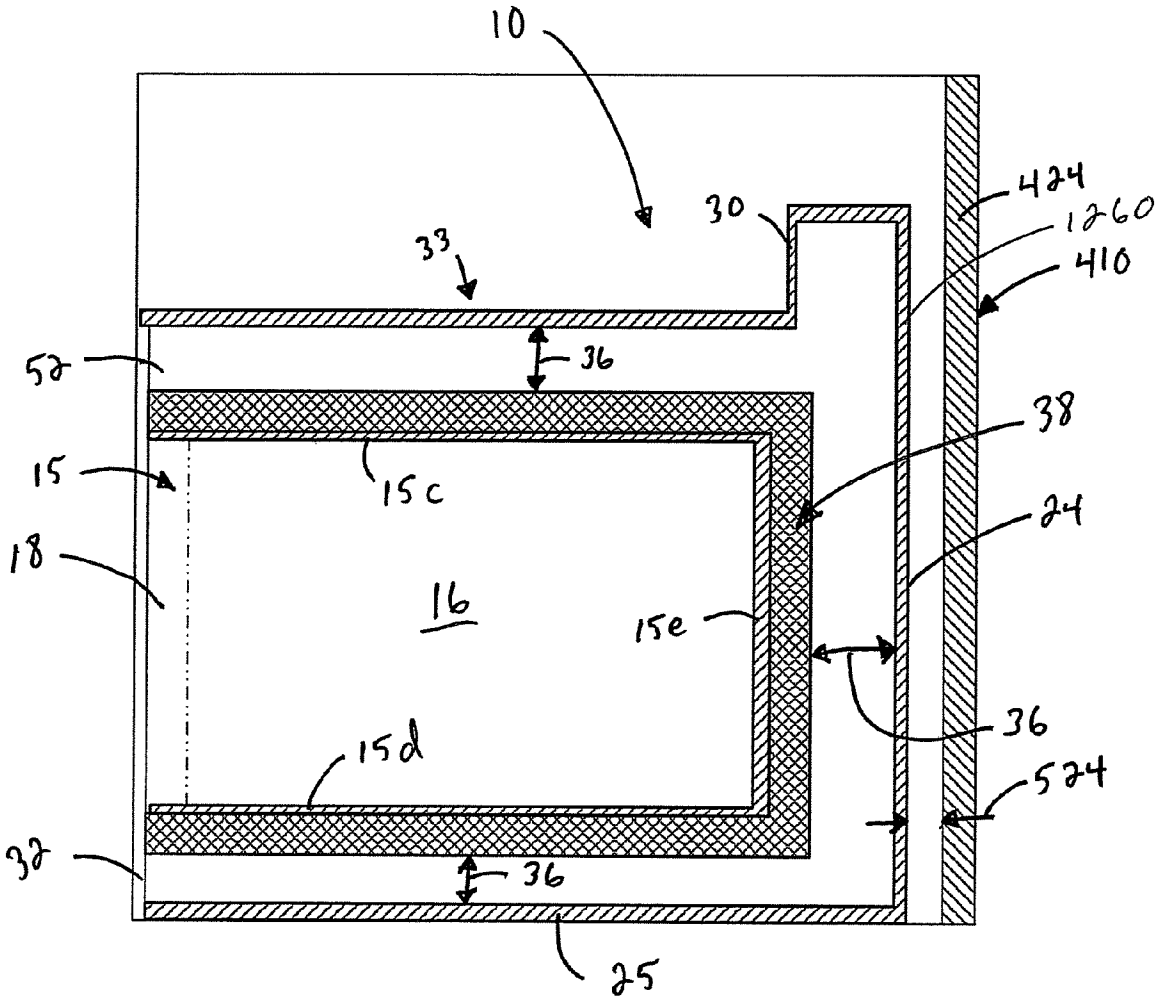
FIG. 6 is a cross-sectional view taken along the plane indicated by lines 6-6 in FIG. 4.

FIGS. 4-6 illustrate an oven 10 positioned within a thermal test fixture 410 for the heat exposure tests, such as the UL858 Standard for Household Electric Ranges and/or ANSI Z21.1. The test fixture 410 includes side walls 452, 454 and a back wall 424 that approximate the space the oven 10 will be installed in at a residence. The pair of opposed side panels 52 and 54 and a back panel 24 of the oven are spaced apart from the side walls 452, 454 and a back wall 424 by small gaps 552, 554 and 524 respectively. Thermocouples are distributed over the pair of opposed side panels 52 and 54 and a back panel 24 for thermal testing of the oven 10.

Figure 7B:
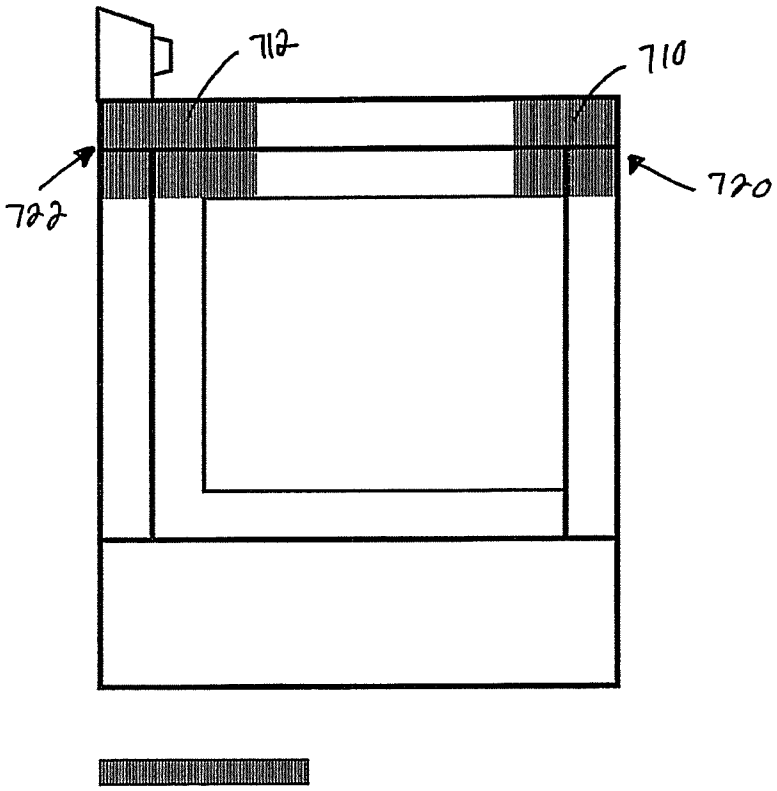
FIGS. 7A and 7B are schematic illustrations showing thermal measurements taken of the oven shown in FIG. 4.
Figure 7A:
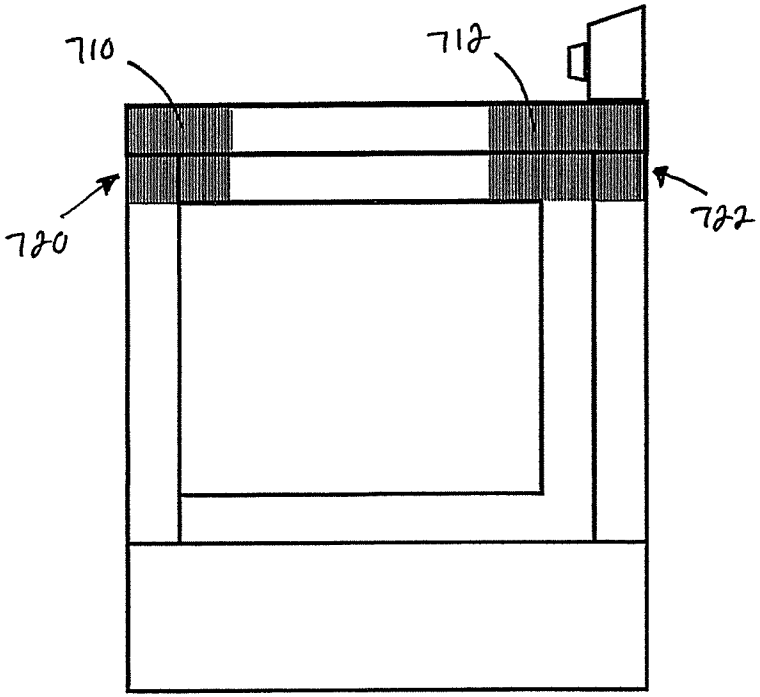

FIGS. 7A and 7B are schematic illustrations showing thermal measurements taken during a test of the oven 10 in the test fixture 410 of FIGS. 4-6. FIG. 7A illustrates thermal measurements of a right side of the oven and FIG. 7B illustrates thermal measurements of a left side of the oven. Shaded areas 710 represents hot spots at upper front corners 720 (See FIG. 4) and shaded areas 712 represent hot spots at rear upper corners 722 (See FIGS. 4 and 6) of the oven during thermal testing in the fixture 410.

Figure 8:
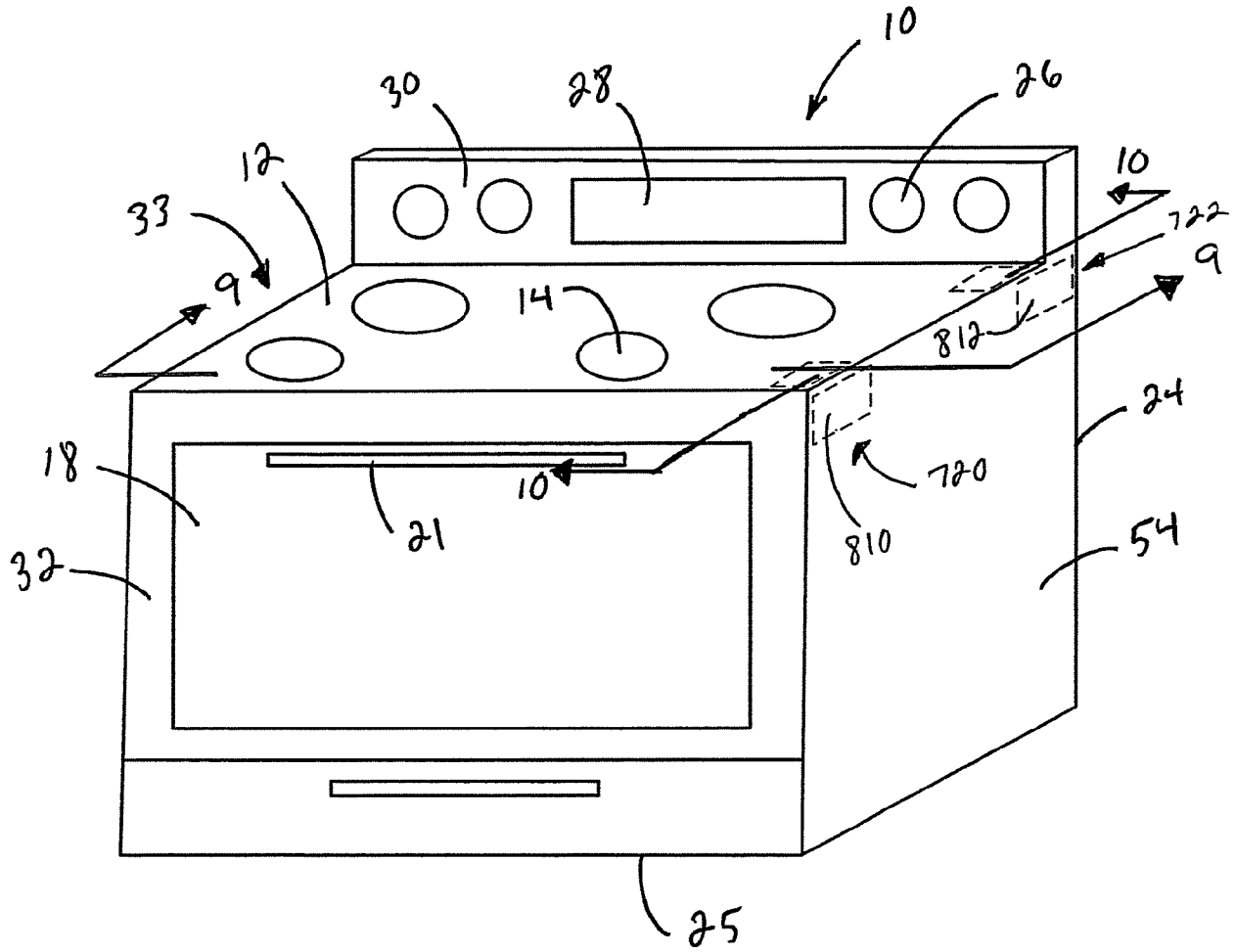
FIG. 8 is a perspective view of an oven similar to the oven illustrated by FIG. 1 with radiant heat shields.
Figure 9:
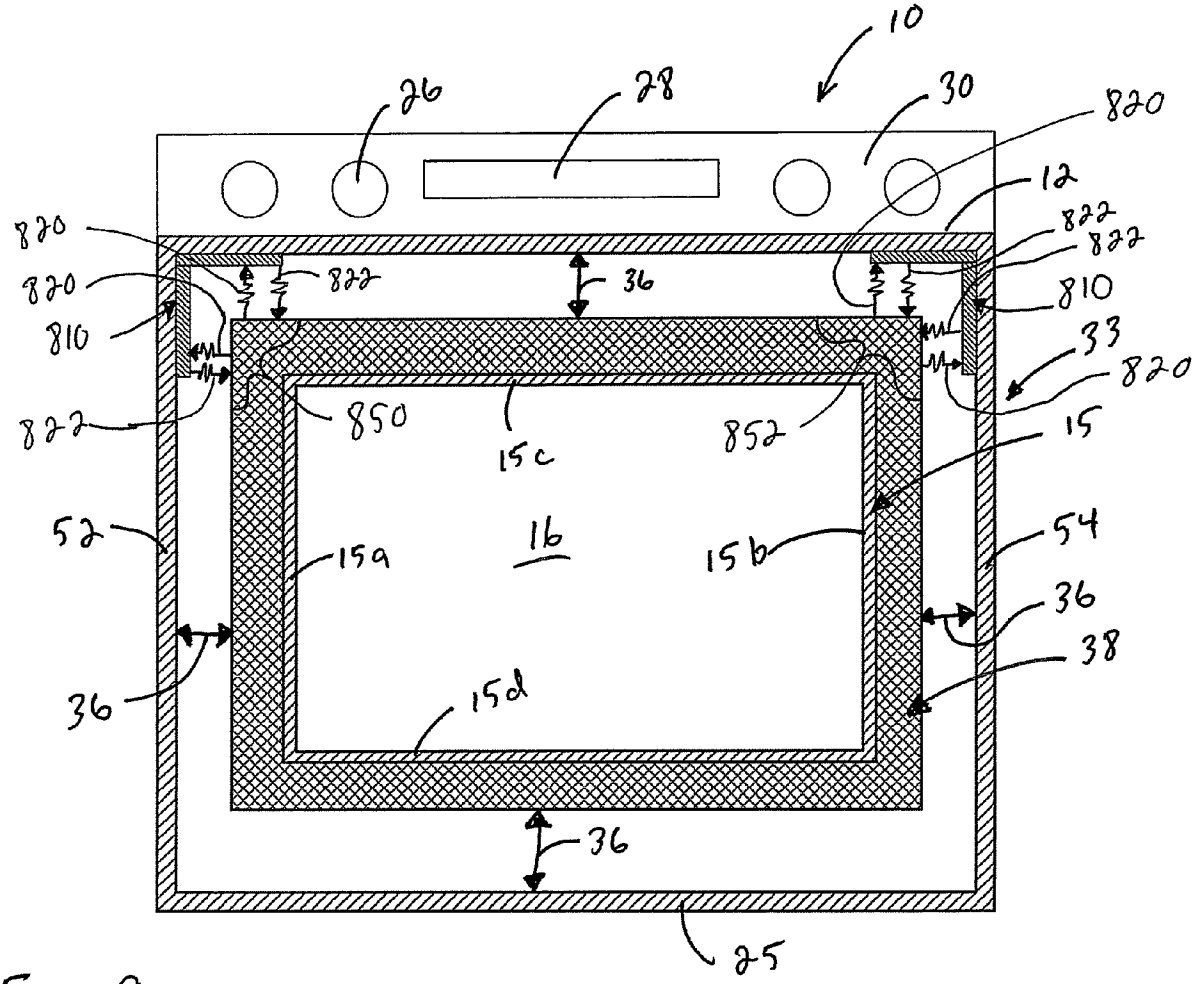
FIG. 9 is a cross-sectional view taken along the plane indicated by lines 9-9 in FIG. 8.
Figure 10:
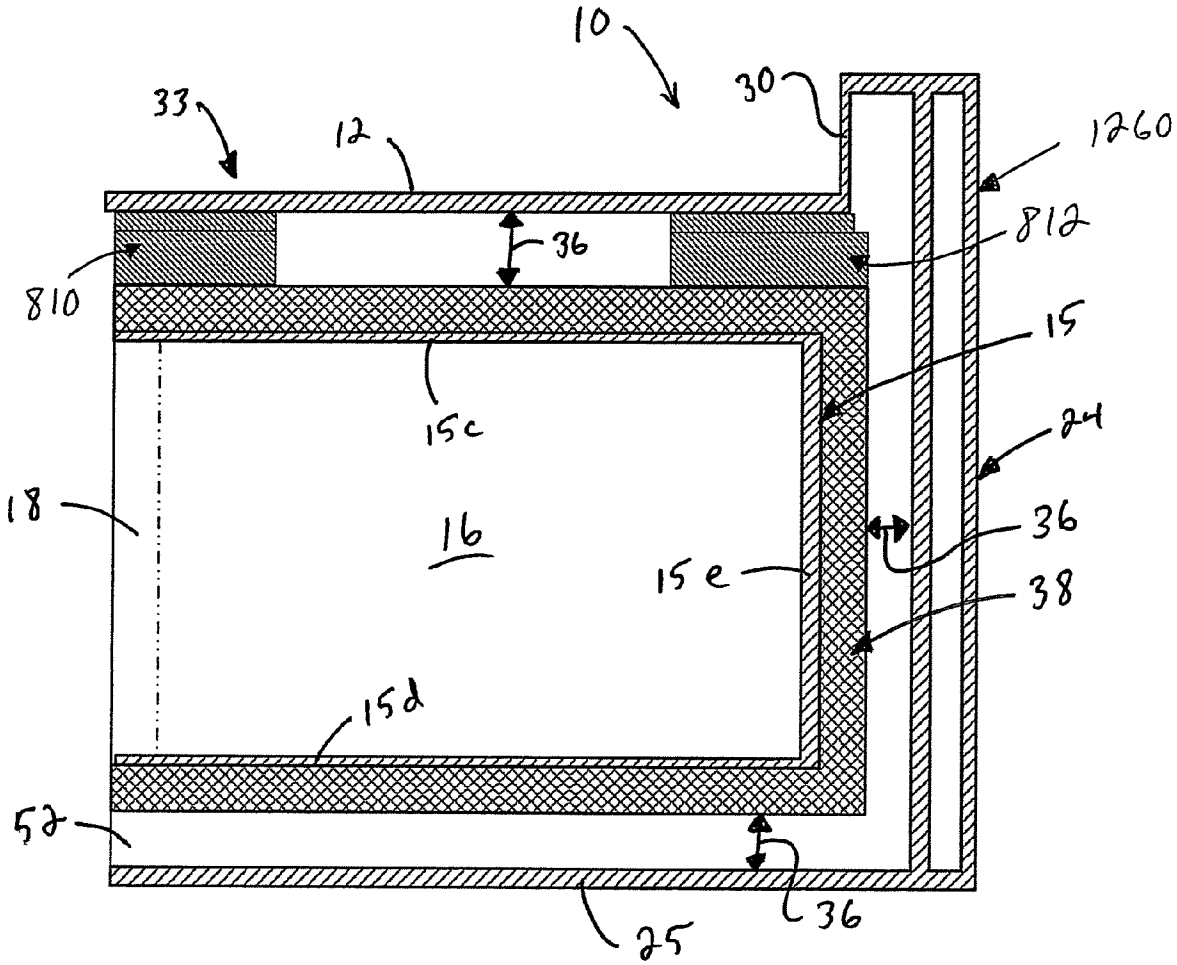
FIG. 10 is a cross-sectional view taken along the plane indicated by lines 10-10 in FIG. 8.

FIG. 8-10 illustrate an exemplary embodiment of an oven 10 with reflective heat shields 810, 812 that reflect radiant heat (indicated by reference character 820) directed at the upper front corners 720 and the rear upper corners 722. By reflecting the radiant heat 820 as indicated by arrow 822, the heat shields 810, 812 reduce the temperature (and thereby eliminate hotspots) at the upper front corners 720 and the upper rear corners 722. The reflective heat shields 810, 812 can take a wide variety of different forms. For example, the reflective heat shields 810, 812 can be a metallic foil, a metalized film, a reflective paint or other reflective coating and/or a polished interior surface of the outer cabinet 33. The reflective heat shields 810, 812 can be made from any material that reflects more radiant heat energy than the interior surfaces of the side panels 52 and 54 and a back panel 24 of the oven. In one exemplary embodiment, the emissivity of the reflective heat shields is greater than 0.1. When the reflective heat shields are made from a metallic foil, the metallic foil may be made from aluminum or another material, such as for example a metalized film.

The reflective heat shields 810, 812 can be positioned to reflect radiant heat energy that would otherwise heat the upper front corners 720 and the upper rear corners 722 in a wide variety of different ways. In the illustrated embodiment, the reflective heat shields 810, 812 are adhered to the upper front corners 720 and the upper rear corners 722 of the oven or the upper front corners 720 and/or the upper rear corners 722 are coated with a material that forms the heat shields 810, 812. In the illustrated embodiment, the reflective heat shields are disposed on an inner surface 830 of the side panels 52, 54 and/or a bottom surface 832 of the top panel 12. In another exemplary embodiment, the reflective heat shields 810, 812 are formed on upper corners 850, 852 of the insulation material 38 to prevent radiant thermal energy from reaching the upper front corners 720 and upper rear corners 722 and thereby prevent hotspots from occurring at these locations.

Figure 11B:
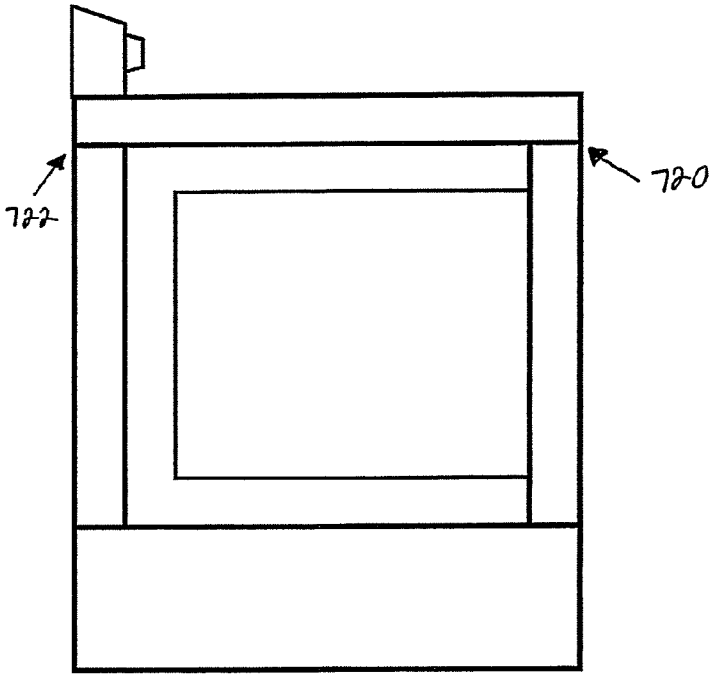
FIGS. 11A and 11B are schematic illustrations showing thermal measurements taken of the oven shown in FIG. 8.
Figure 11A:
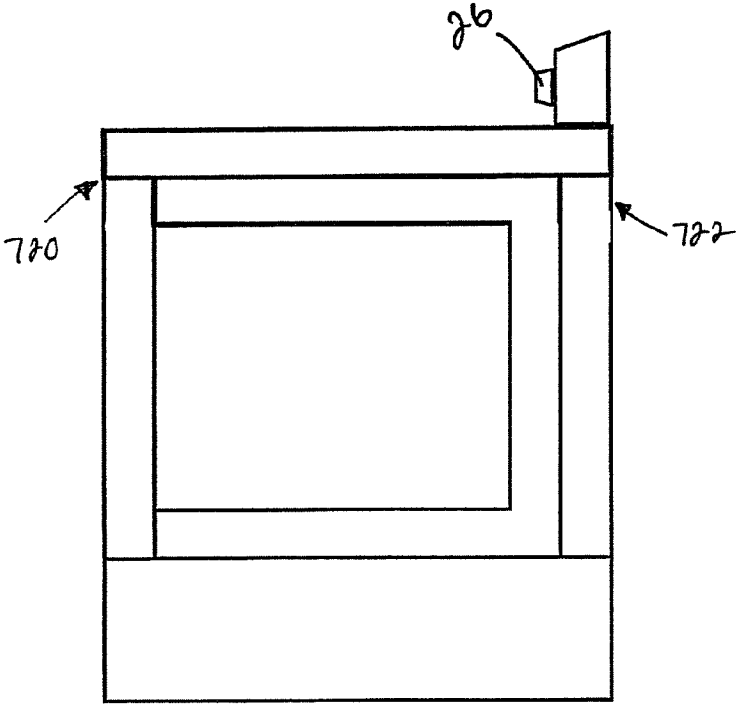

FIGS. 11A and 11B are schematic illustrations similar to FIGS. 7A and 7B showing thermal measurements taken during a test of an oven 10 having the heat shields 810, 812 in the test fixture 410 of FIGS. 4-6. As can be seen from FIGS. 11A and 11B, the hot spots at upper front corners 720 and at rear upper corners 722 of the oven during thermal testing in the fixture 410 are reduced or eliminated.

Figure 12:
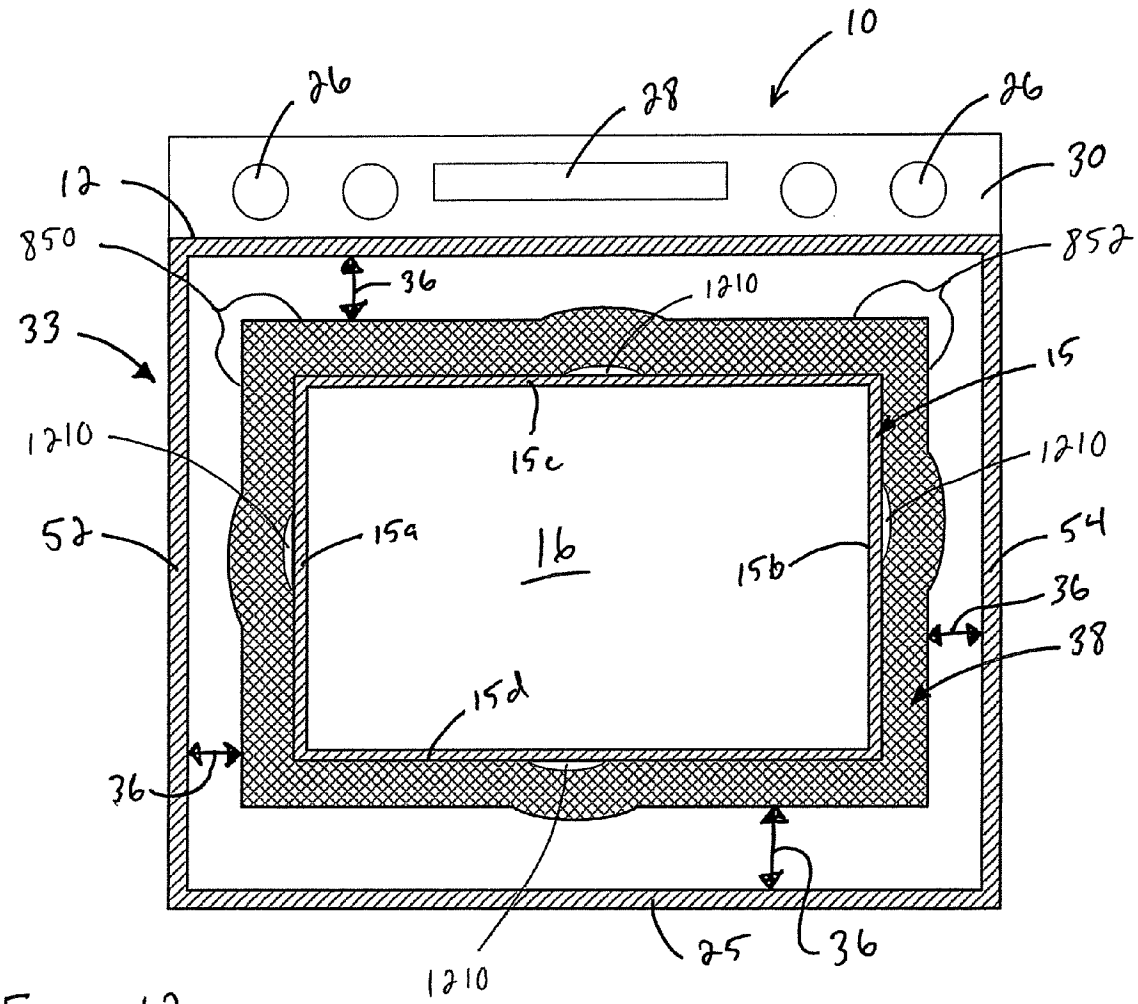
FIG. 12 is a view similar to the view illustrated by FIG. 2 illustrating gaps between insulation and an oven liner.
Figure 13:
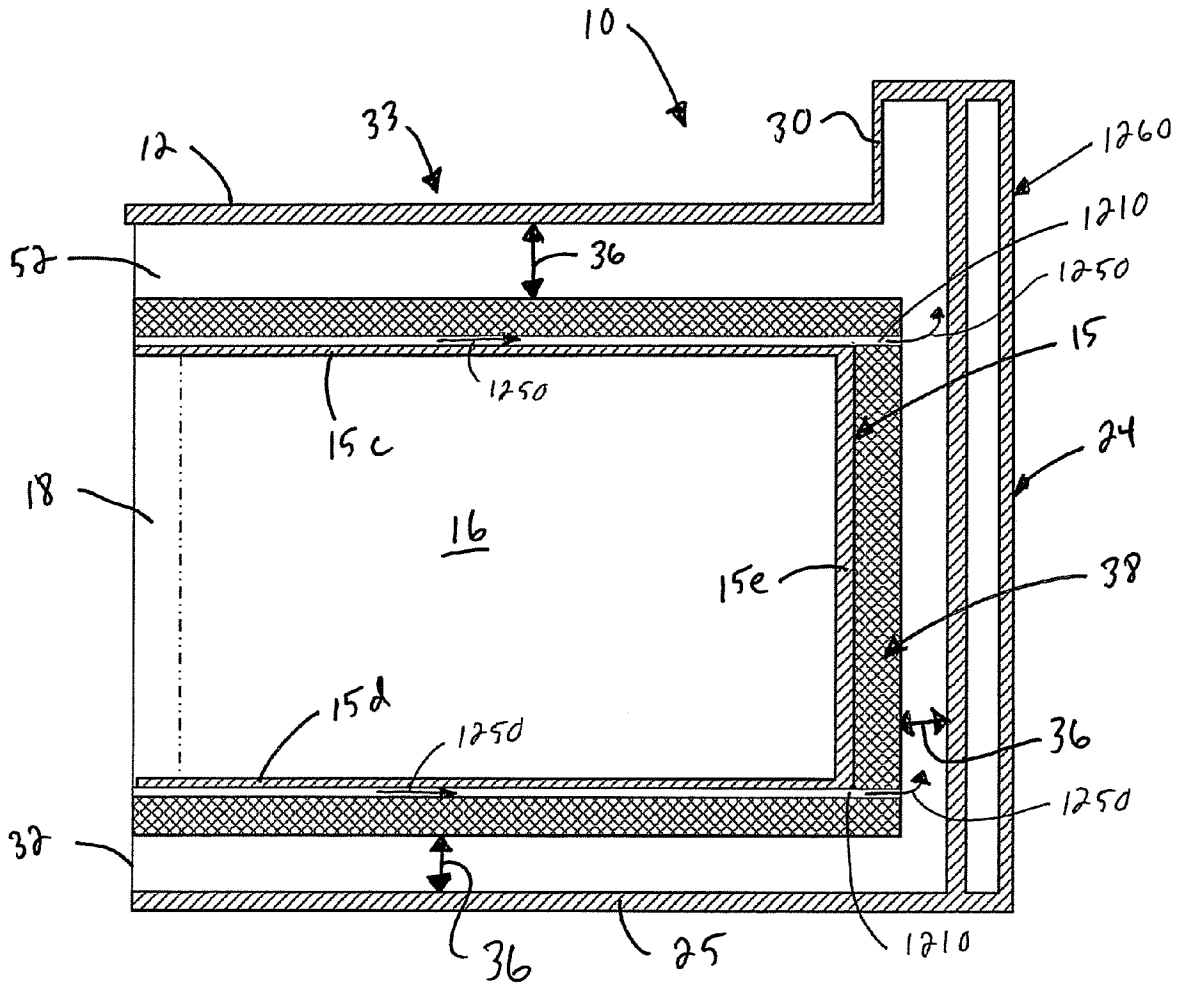
FIG. 13 is a side elevational sectional view showing the gaps illustrated by FIG. 12.
Figure 14:
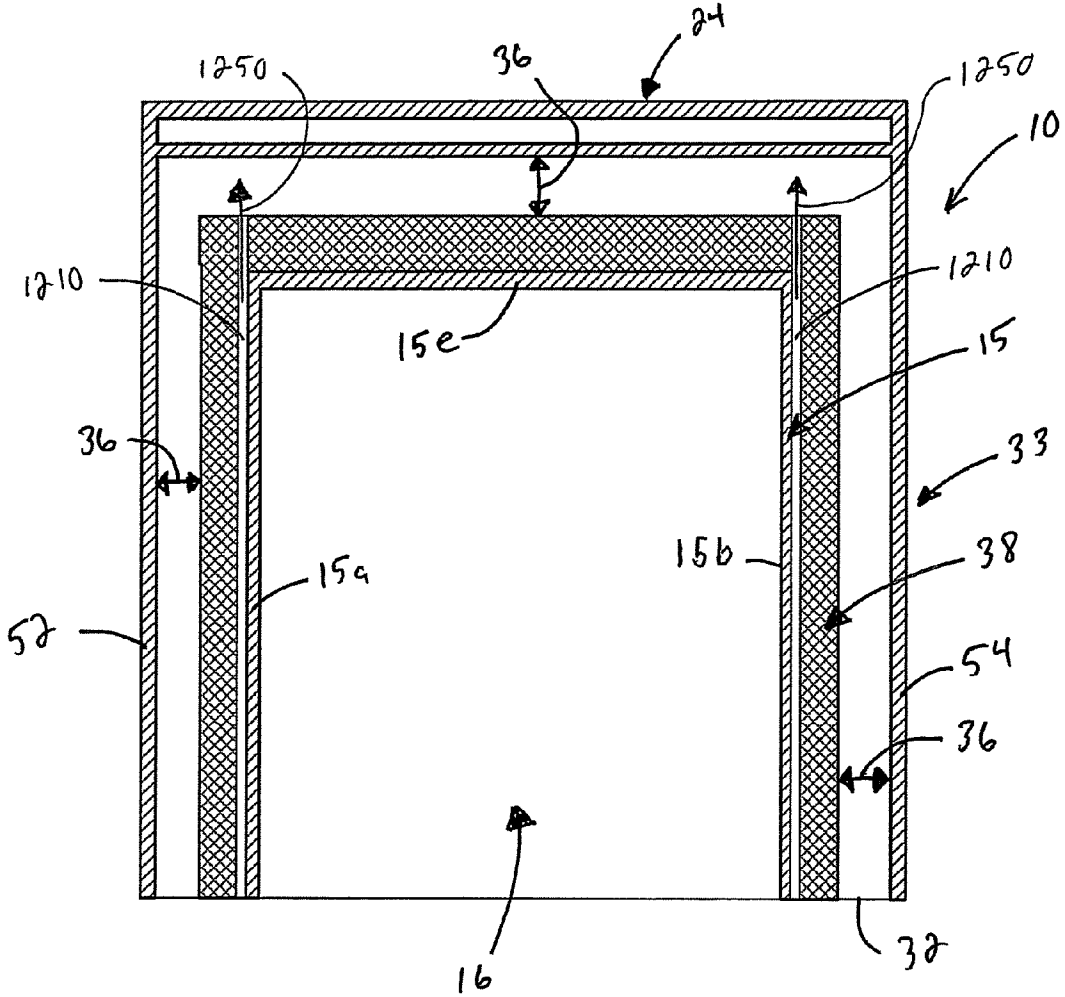
FIG. 14 is a top elevational sectional view taken along the plane indicated by lines 14-14 in FIG. 1 showing the gaps illustrated by FIG. 12.

FIGS. 12-14 illustrate that when the insulation 38 is installed on the oven liner 15, one or more gaps 1210 may form between the insulation 38 and the oven liner 15. For example, the insulation 38 may bunch up on the opposing liner sides 15*a* and 15*b*, the liner top 15*c*, the liner bottom 15*d* and/or a liner back 15*e* to form one or more gaps 1210. When a gap 1210 is present, air in the gap 1210 is heated by the oven liner 15, may flow out of the gap 38 as indicated by arrow 1250 (See FIGS. 13 and 14), and heat an interior surface of the outer oven cabinet 33. For example, the heated air from the gap 1210 may heat an upper surface 1260 of the back panel 24 and cause a hotspot at that location. However, the heated air from the gap 1210 may cause one or more hotspot at any location or locations of the outer oven cabinet 33.

Figure 15:
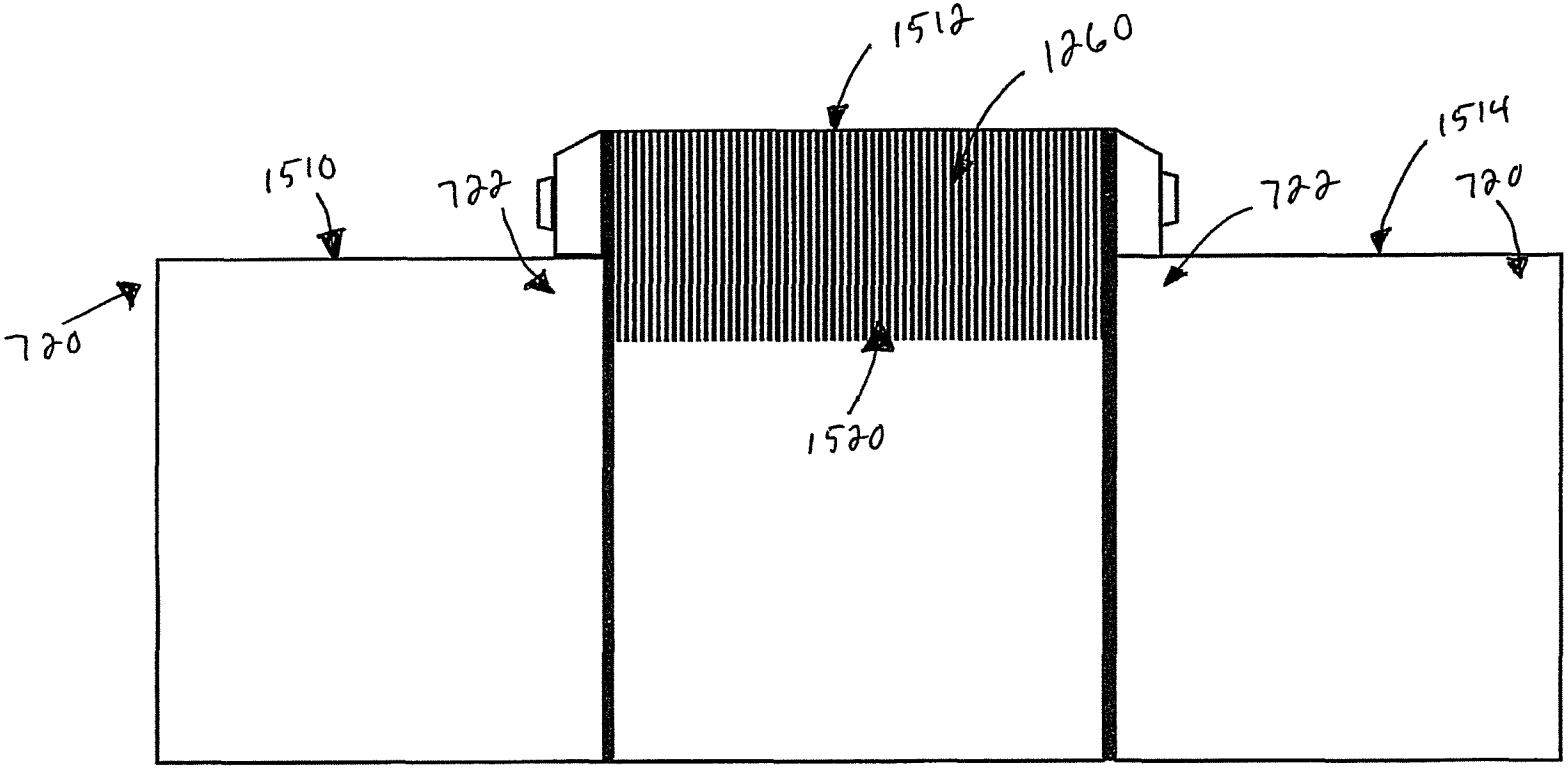
FIG. 15 is a schematic illustrations showing thermal measurements taken of the oven shown in FIGS. 12-14.

FIG. 15 is a schematic illustration showing thermal measurements taken during a test of the oven 10 with one or more gaps 1210 as shown in FIGS. 12-14 in the test fixture 410 of FIGS. 4-6. In FIG. 15, portion 1510 represents thermal measurements of a right side of the oven 10, portion 1512 represents thermal measurements of the back panel 24, and portion 1514 represents thermal measurements of the left side of the oven 10. Shaded areas 1520 represent hot spots at the upper portion 1260 of the back panel 24 having one or more gaps 1210 illustrated by FIGS. 12-14 during thermal testing in the fixture 410.

Figure 16:
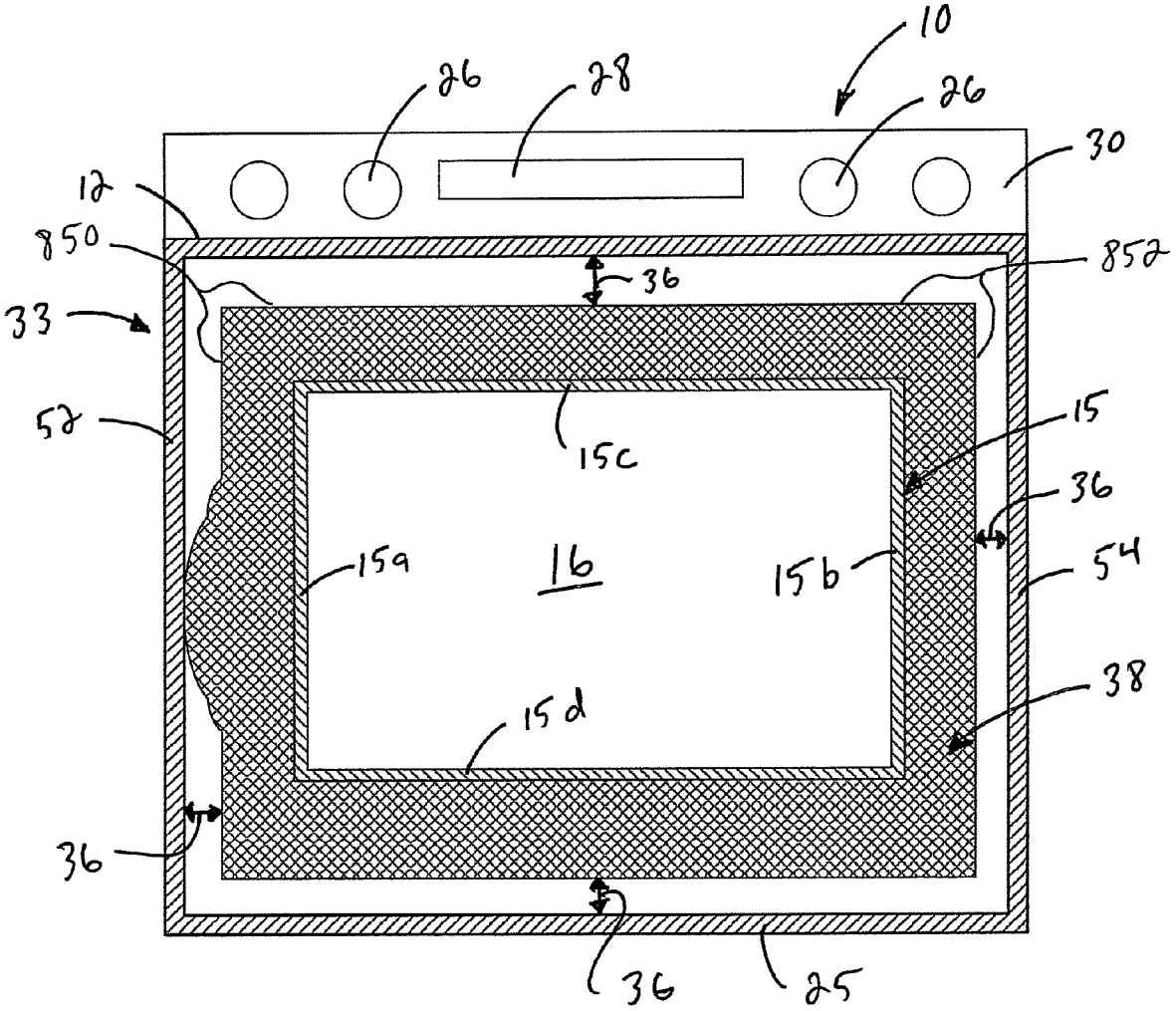
FIG. 16 is a view similar to the view illustrated by FIG. 2 illustrating insulation contact with an outer oven cabinet.

FIG. 16 illustrates that when the insulation 38 is installed on the oven liner 15, the insulation may contact the outer oven cabinet 33. For example, the insulation 38 may bunch up on the opposing liner sides 15*a* and 15*b*, the liner top 15*c*, the liner bottom 15*d* and/or a liner back 15*e* and come into contact with the outer oven cabinet 33. When the insulation 38 contacts the outer oven cabinet 33, heat in the insulation 38 is conducted directly into the cabinet 33. In the illustrated example, the insulation 38 contacts the left side 52, causing heat in the insulation 38 to be conducted into the left side panel 52 and a resulting hotspot at that location. However, the contact between the insulation 38 and the cabinet 33 and resulting hotspot may be at any location of the outer oven cabinet 33.

Figure 17:
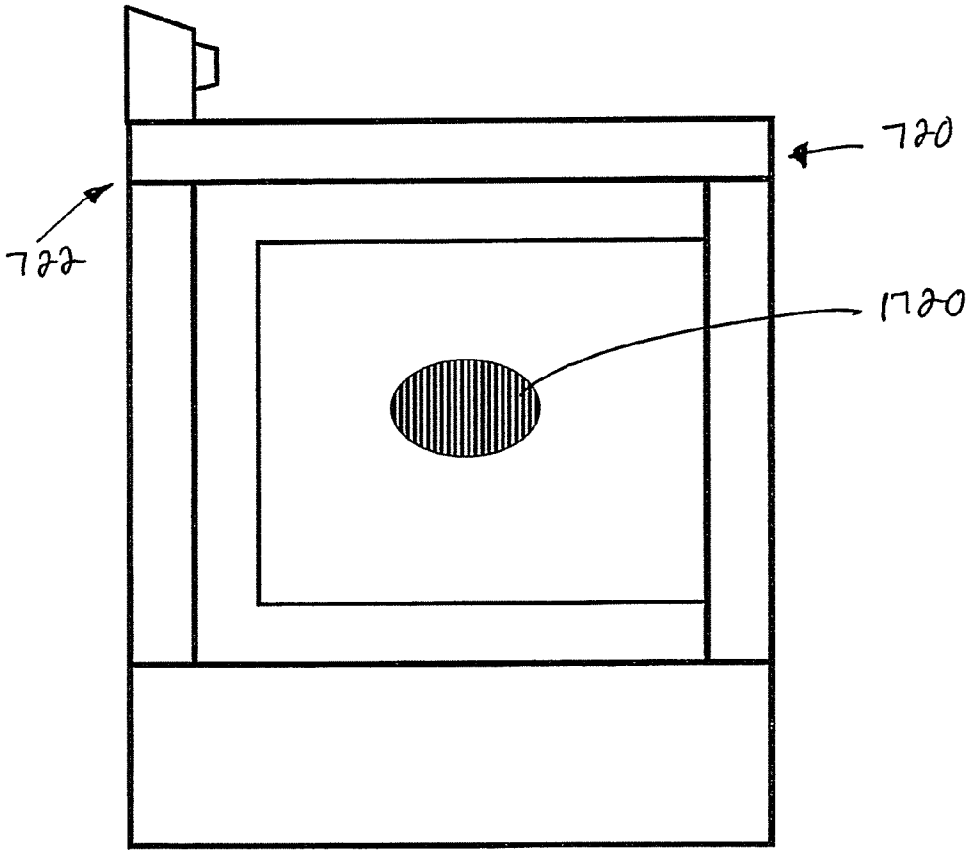
FIG. 17 is a schematic illustrations showing thermal measurements taken of the oven shown in FIG. 16.

FIG. 17 is a schematic illustration showing thermal measurements taken during a test of the oven 10 with contact between the insulation 38 and the left side 52 in the test fixture 410 of FIGS. 4-6. Shaded area 1720 represents a hot spot in the middle of the left side panel 52.

Figure 18:
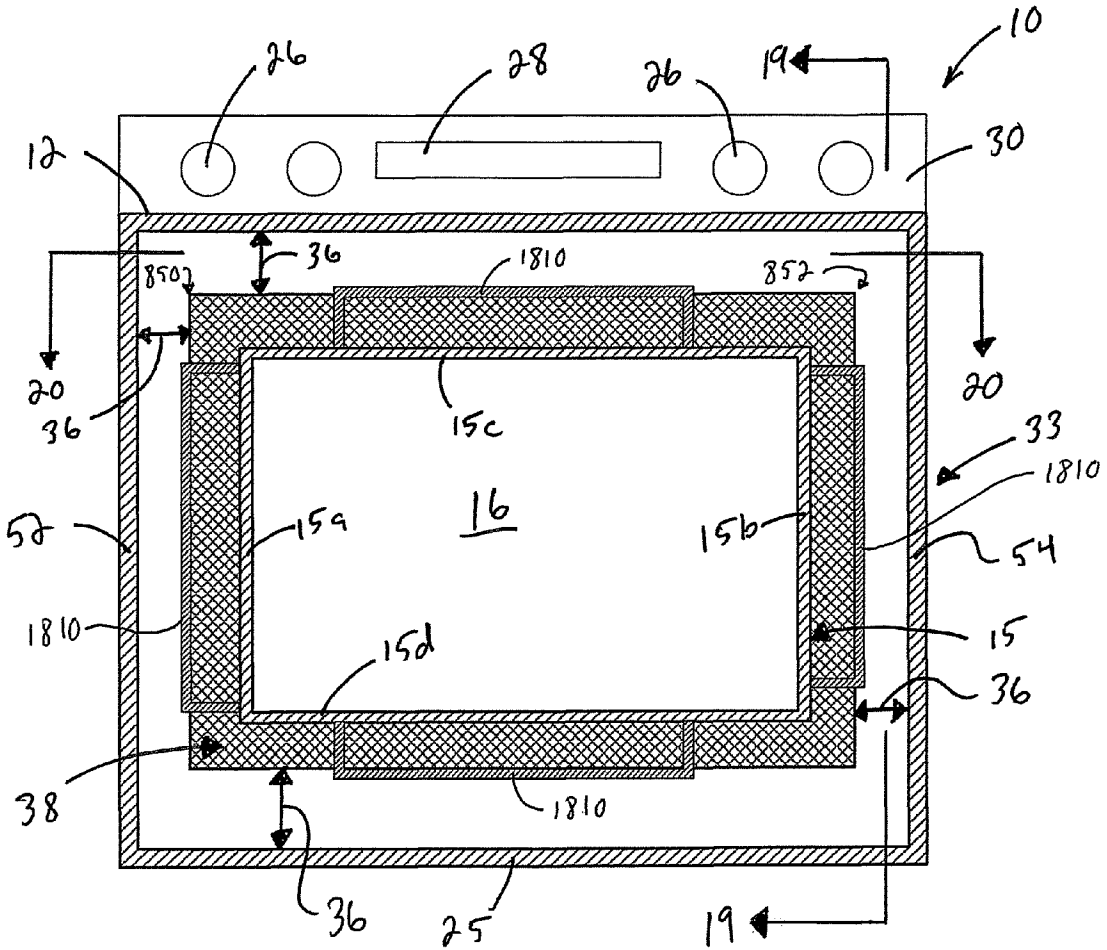
FIG. 18 is a view similar to the view of FIG. 2 where the oven includes clips that prevent gaps between the insulation and the oven liner and prevents insulation from making contact with the outer oven cabinet.
Figure 19:
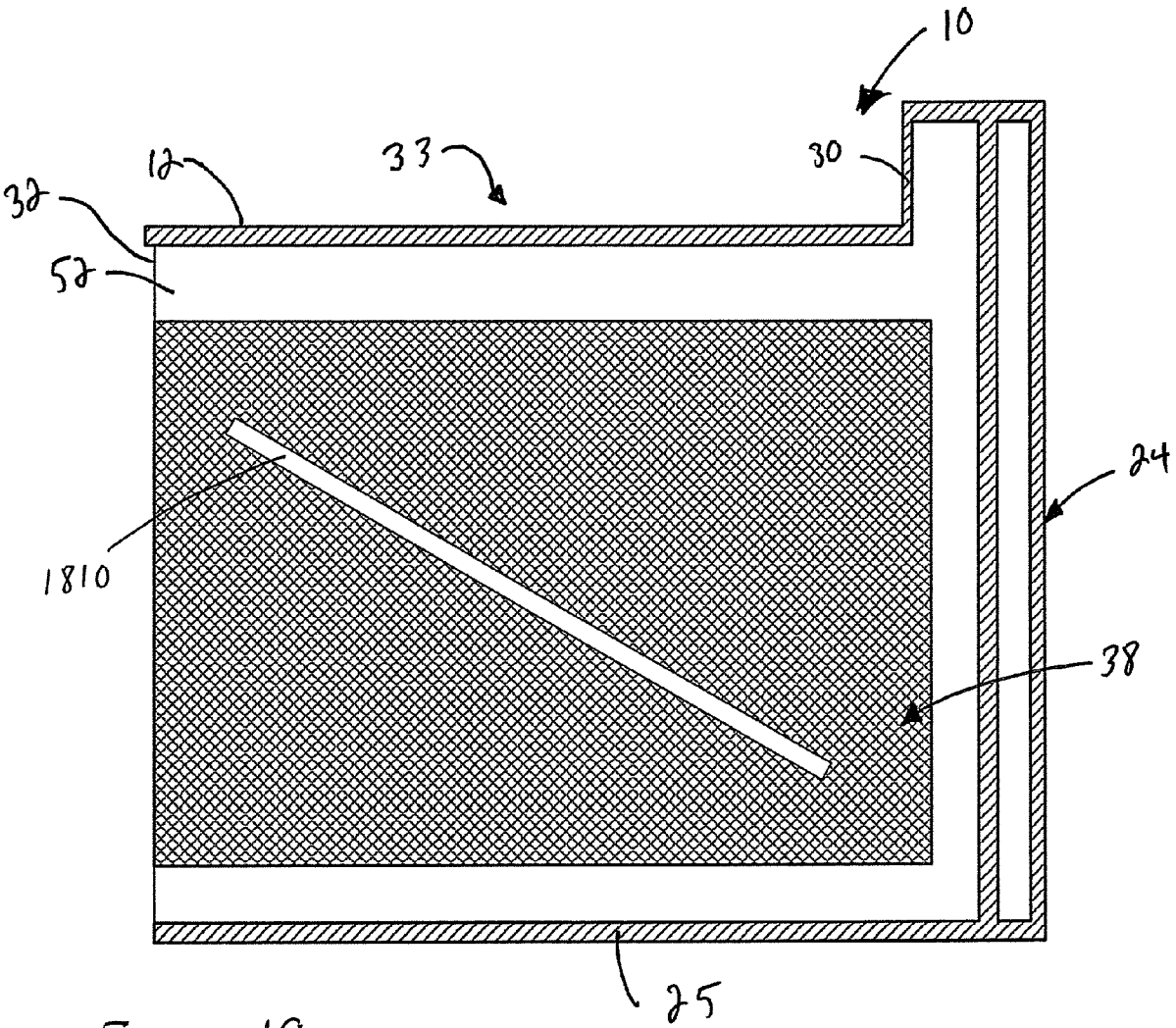
FIG. 19 is a sectional view taken along the plane indicated by lines 19-19 in FIG. 18 showing clips illustrated by FIG. 18.
Figure 20:
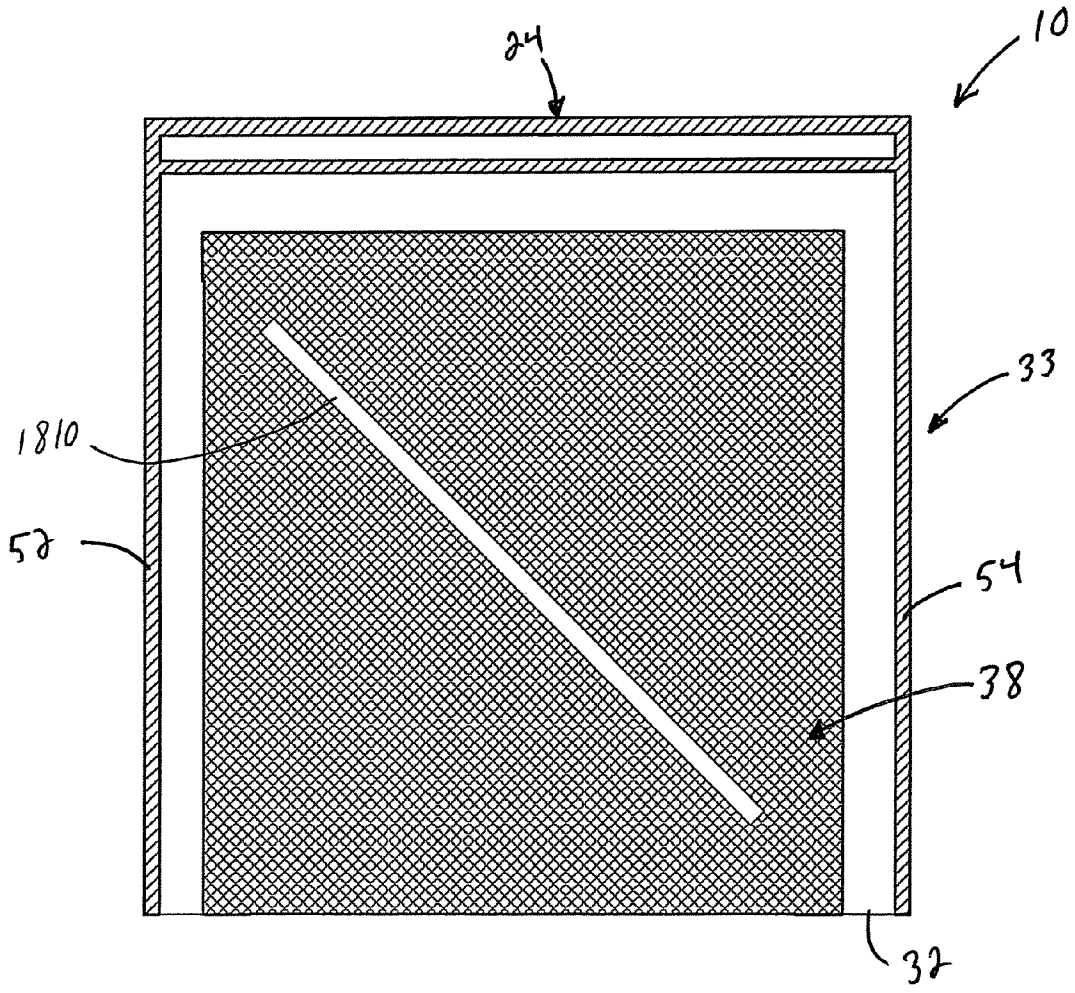
FIG. 20 is a sectional view taken along the plane indicated by lines 20-20 in FIG. 18 showing clips illustrated by FIG. 18.

FIGS. 18-20 illustrate an exemplary embodiment of an oven 10 with one or more retainers 1810 that keep the insulation 38 in continuous contact with the oven liner 15 such that no gaps 1210 (See FIGS. 12-14) are formed between the oven liner 15 and/or that prevent the insulation 38 from contacting the outer cabinet 33. By eliminating the gaps 1210 and contact between the insulation 38 and the outer cabinet 33, hotspots due to air heated in the gap 1210 and contact between the insulation 38 and the cabinet 33 are reduced or eliminated.

The retainers 1810 can take a wide variety of different forms. In the illustrated embodiment, the retainers 1810 are discrete clips provided on one or more of the opposing liner sides 15*a* and 15*b*, the liner top 15*c*, the liner bottom 15*d* and the liner back 15*e*. In the illustrated example, one clip is attached to each of the opposing liner sides 15*a* and 15*b*, the liner top 15*c*, the liner bottom 15*d* and the liner back 15*e*. However, any number of clips can be provided on any of the opposing liner sides 15*a* and 15*b*, the liner top 15*c*, the liner bottom 15*d* and the liner back 15*e*. In some embodiments, no clips are provided at one or more of the opposing liner sides 15*a* and 15*b*, the liner top 15*c*, the liner bottom 15*d* and the liner back 15*e*. In another exemplary embodiment, the retainers 1810 are not connected to the liner 15. For example, the retainers 1810 may be spacers mounted to one or more of the pair of opposed side panels 52 and 54, the back panel 24, the bottom panel 25, and the front panel 32 that press the insulation 38 against the liner 15. The retainers 1810 can take any form that eliminates the gaps 1210 and/or contact between the insulation 38 and the outer cabinet The retainers 1810 can be made from a wide variety of different materials. In one exemplary embodiment, the retainers 1810 are made from a material having a low thermal conductivity. By making the retainers from a material with a low thermal conductivity, heat that is conducted from the liner 15, through the retainer 1810, and to the outside of the insulation 38 is minimized. The retainers 1810 can be positioned in a wide variety of different ways. In the illustrated examples, the retainers 1810 are oriented at angles over the face of the insulation with a center of the retainer positioned over the center of the insulation face. This orientation eliminates the gaps 1210 and contact between the insulation 38 and the housing 33. However, the retainers can be positioned in a wide variety of different orientations than as shown.

Figure 21:
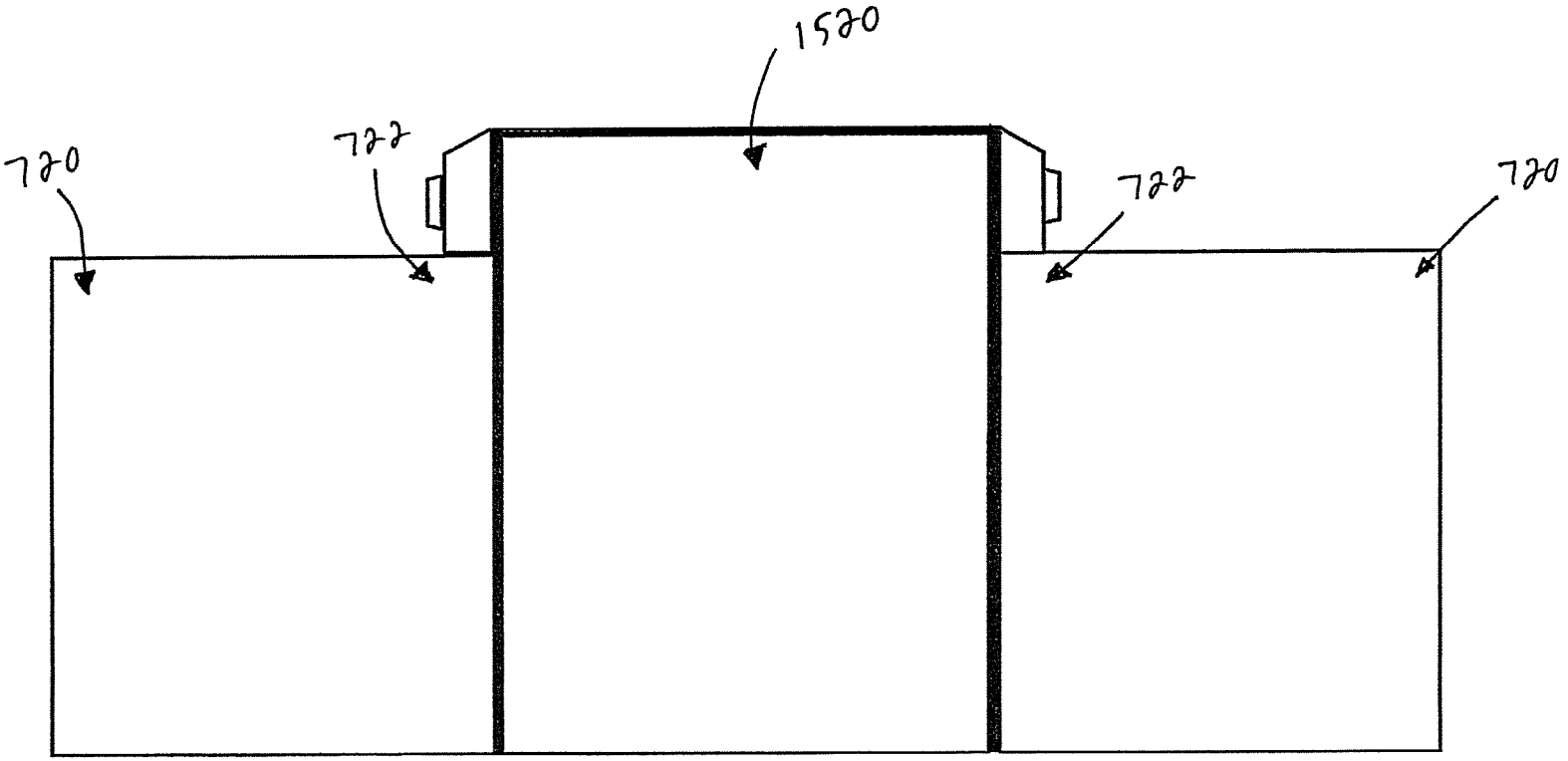
FIG. 21 is a view similar to FIG. 15 illustrating the effect of the clips shown in FIGS. 18-20.
Figure 22:
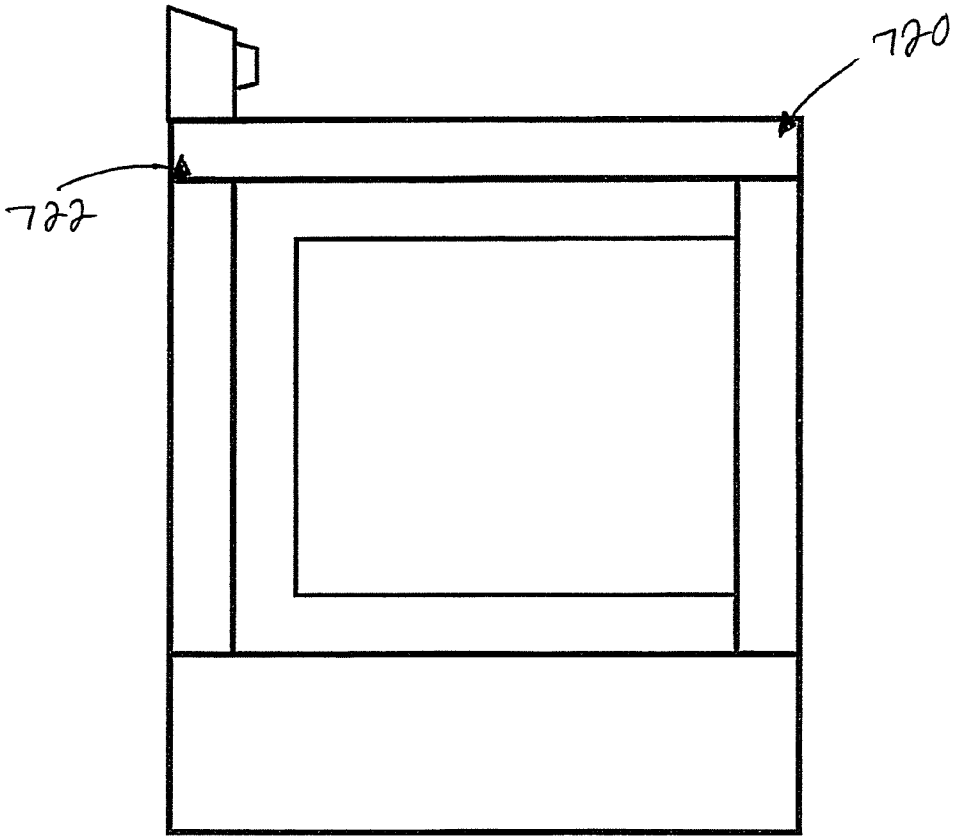
FIG. 22 is a view similar to FIG. 17 illustrating the effect of the clips shown in FIGS. 18-20.

FIGS. 21 and 22 are schematic illustrations similar to FIGS. 15 and 17 showing thermal measurements taken during a test of an oven 10 having the retainers 1810 in the test fixture 410 of FIGS. 4-6. As can be seen from FIGS. 21 and 22, the hot spots at the upper portion 1520 of the back panel 24 and the hot spot in the middle of the left side panel 52 during thermal testing in the fixture 410 are reduced or eliminated.

Figure 23:
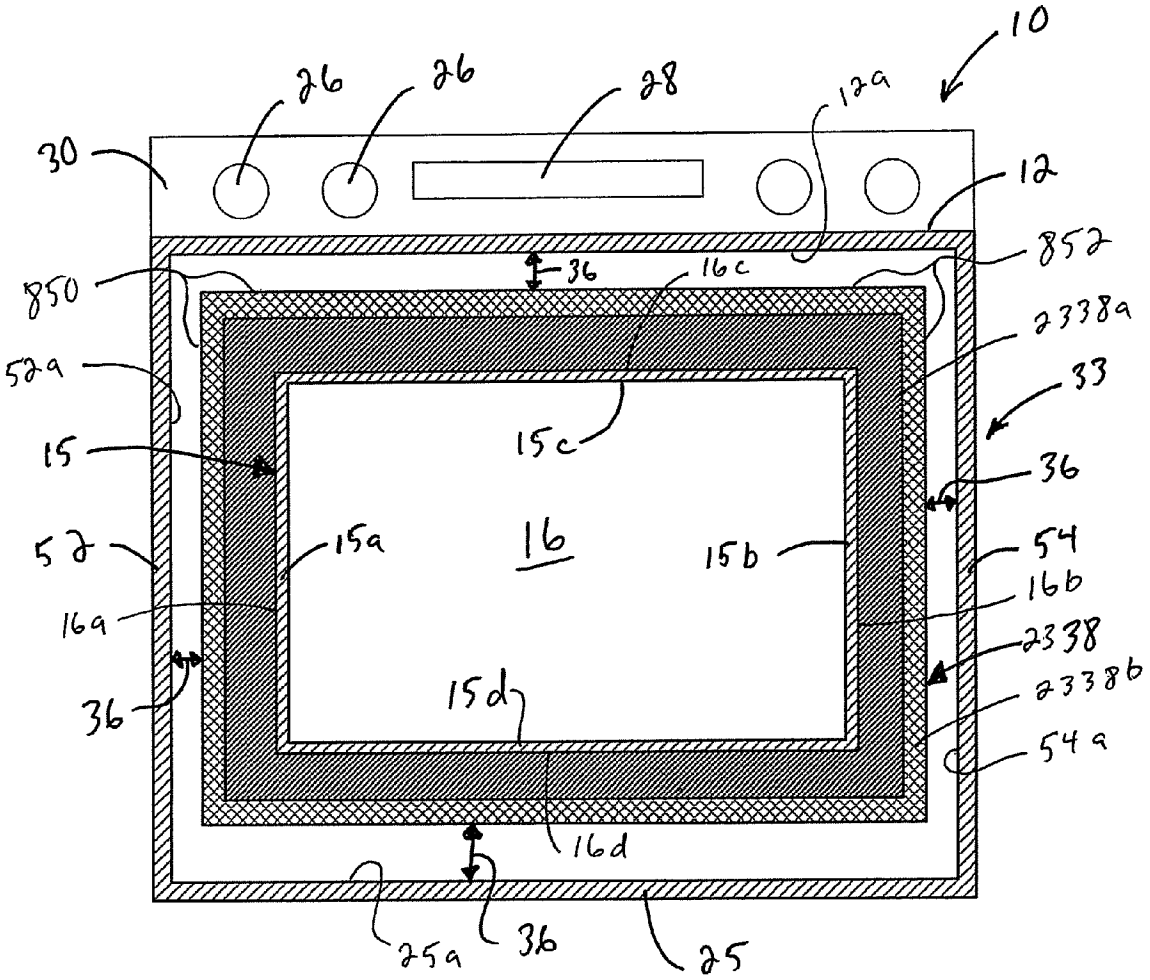
FIG. 23 is a view similar to FIG. 2 of an oven having a high density inner insulation layer and a low density outer insulation layer.
Figure 24:
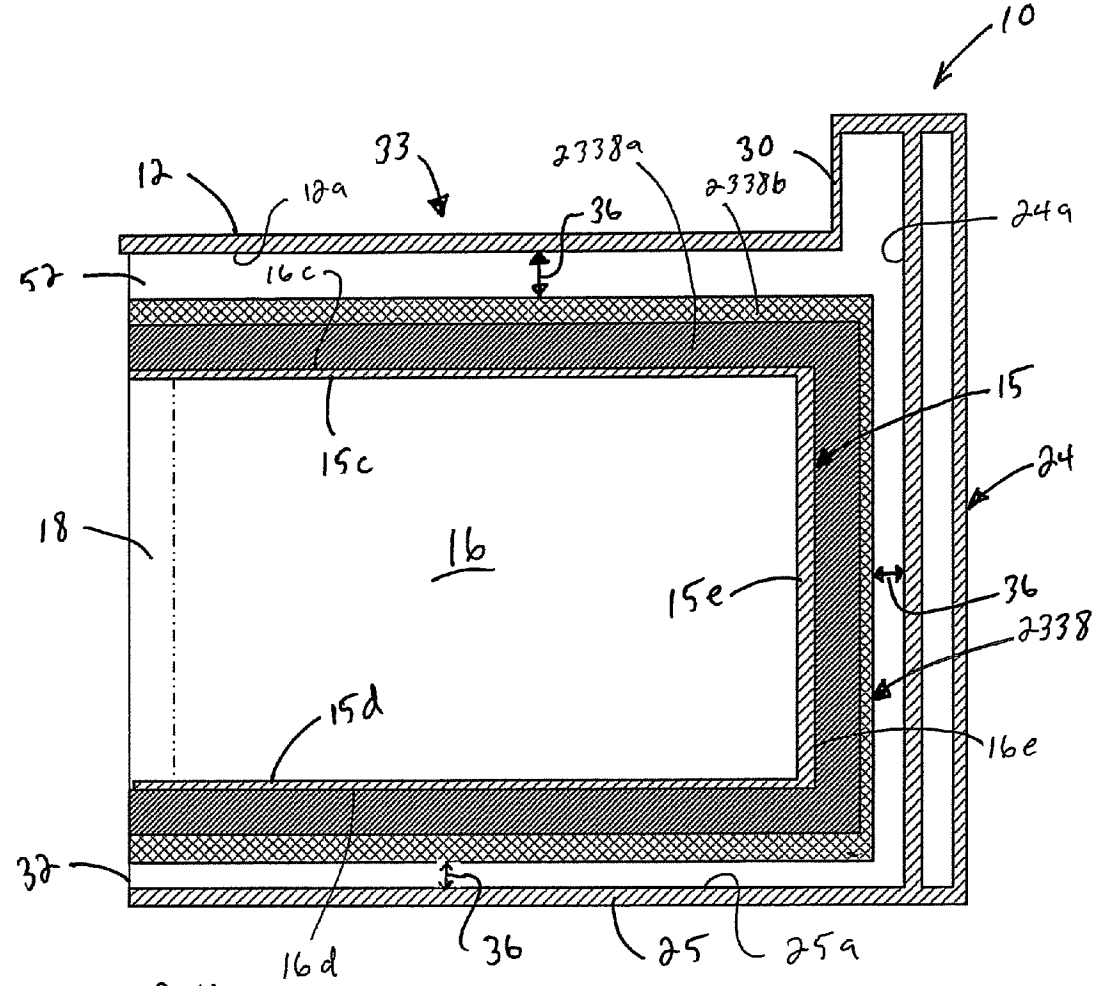
FIG. 24 is a view similar to FIG. 3 of an oven having the insulation layers shown in FIG. 23.
Figure 25:
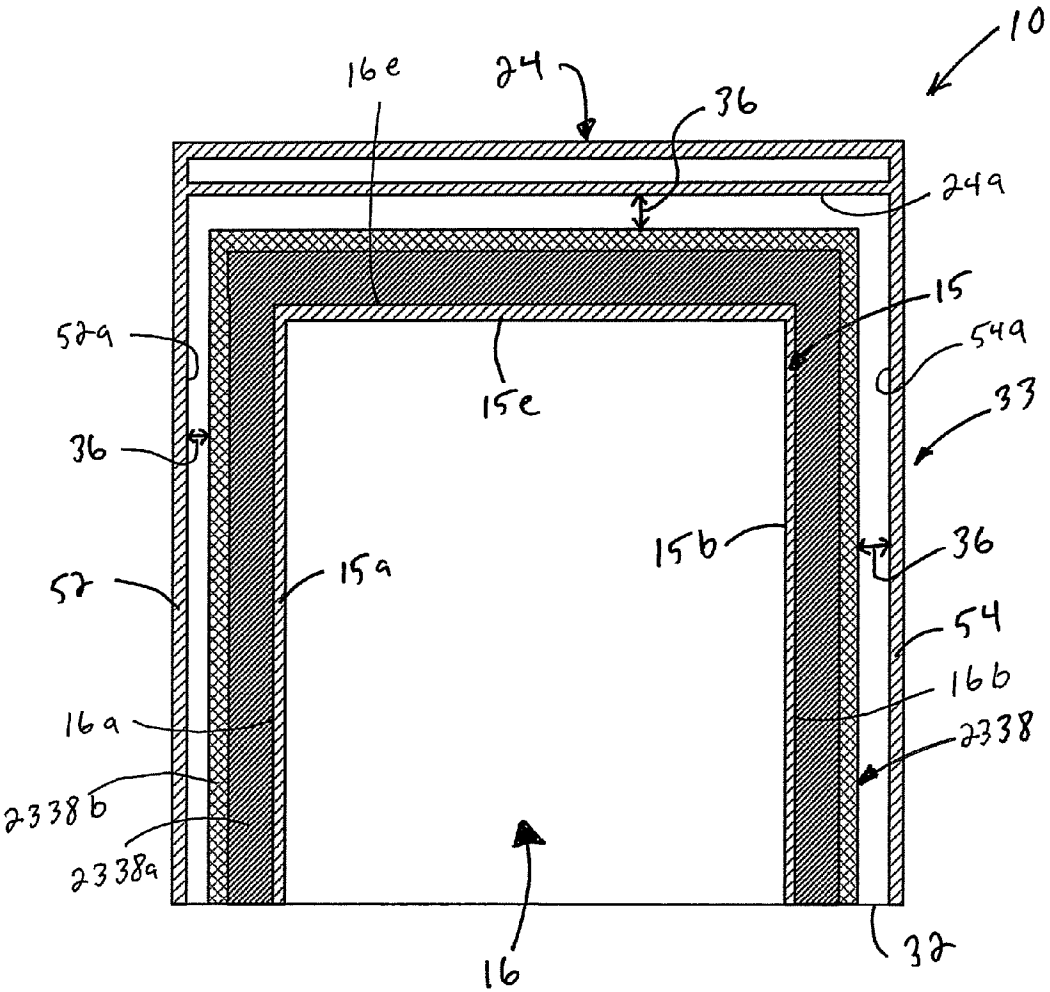
FIG. 25 is a view similar to FIG. 14 of an oven having the insulation layers shown in FIG. 23.

Referring now to FIGS. 23-25, there is illustrated an improved thermal oven 10. As will be explained in detail below, the thermal oven 10 of this exemplary embodiment includes a multiple layer insulation material 2338. The multiple layer insulation material 2338 is positioned between outer surfaces 16*a*, 16*b*, 16*c*, 16*d* and 16*e* of the opposing liner sides, liner top, liner bottom, and liner back, 15*a*, 15*b*, 15*c*, 15*d* and 15*e* and interior surfaces 52*a*, 54*a*, 25*a*, 24*a* and 12*a* of the opposed side panels, back panel, bottom pane and cooking surface 52, 54, 25, 24 and 12 respectively. In one embodiment, each of the layers of the fibrous insulation material 2338 is made of glass fibers. For example, the fibrous insulation material 2338 can be binderless and/or be held together with dry binder as described above. Alternatively, the fibrous insulation material 38 can be another insulation material, such as for example mineral wool, rock wool, polymer fibers, sufficient to insulate the oven cavity 16.

In the exemplary embodiment illustrated by FIGS. 23-25 the thermal oven 10 has an inner insulation material 2338*a* is positioned in contact with the outside surfaces 16*a*, 16*b*, 16*c*, 16*d* and 16*e* of the liner 15 and an outer insulation material 2338*b* disposed around the inner insulation material 2338*a*. In an exemplary embodiment, the inner insulation material 2338*a* is a high density insulation and is configured to provide a predetermined level of thermal insulation. Alternatively, the inner insulation material 2338*a* can be any insulation sufficient to provide a predetermined level of thermal insulation. The inner insulation material 2338*a* has a thickness t1. In one embodiment, the thickness t1 is in a range from about 0.50 inches (1.27 cm) to about 1.5 inches (3.81 cm). In another embodiment, the thickness t1 can be less than 0.50 inches (1.27 cm) or more than 1.5 inches (3.81 cm). In one embodiment, the inner insulation material 2338*a* has a density in a range from about 1.0 lb/ft^3 to about 15.0 lb/ft^3. In another embodiment, the inner fibrous insulation material 2338*a* can have a density less than 1.0 lb/ft^3 or more than 15.0 lb/ft^3.

In one exemplary embodiment, the outer insulation material layer 2338*b* is low density insulation and is configured to replace a portion of the air gap 36 with a semi-transparent thermal insulation. This low density, semi-transparent outer insulation layer 2338*b* prevents the high density layer 2338*b* from contacting the outer housing and thereby prevents hot spots due to conduction from the high density layer 2338*b* to the housing 33. Alternatively, the outer insulation material 2338*b* can be an insulation sufficient to provide thermal insulation. The outer insulation material layer 2338*b* has a thickness t2. In one embodiment, the thickness t2 is in a range from about 0.50 inches (1.27 cm) to about 1.5 inches (3.81 cm). In another embodiment, the thickness t2 can be less than 0.50 inches (1.27 cm) or more than 1.5 inches (3.81 cm).

In the embodiment shown in FIGS. 23-25, the outer insulation material 2338*b* reduces convective heat transfer while having little of no effect on radiative heat transfer. The outer insulation material 2338*b* is therefore typically a lower density than the inner insulation material 2338*b*. The outer insulation material 2338*a* is also typically more transparent to thermal radiation (in a range from about 0.1 micron to about 100 micron wavelength) than the inner insulation material 2338*b*.

Figure 26:
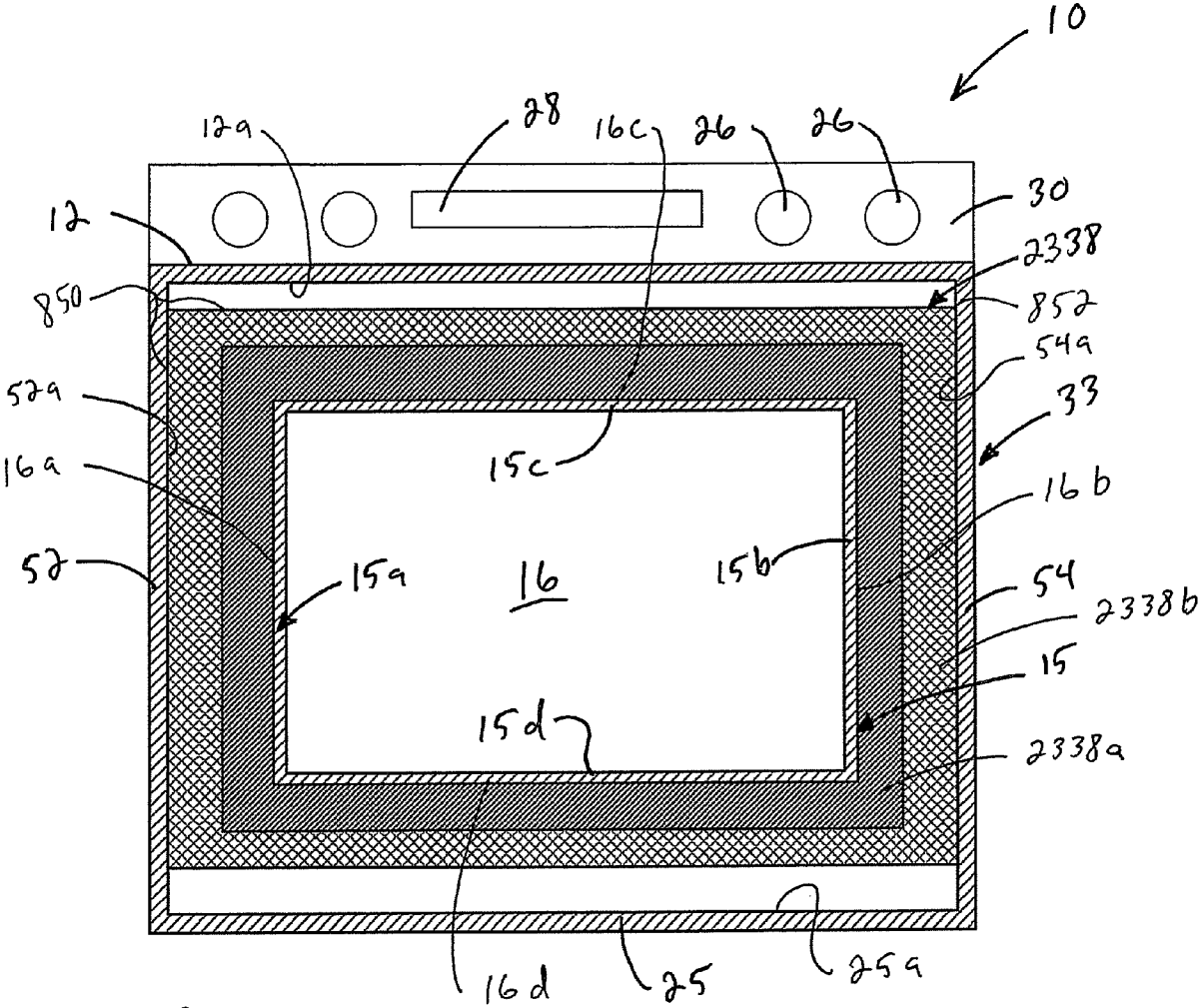
FIG. 26 is a view of an exemplary embodiment of an oven that is similar to the embodiment illustrated by FIG. 23 where the low density outer insulation layer is configured to contact the outer oven cabinet.
Figure 27:
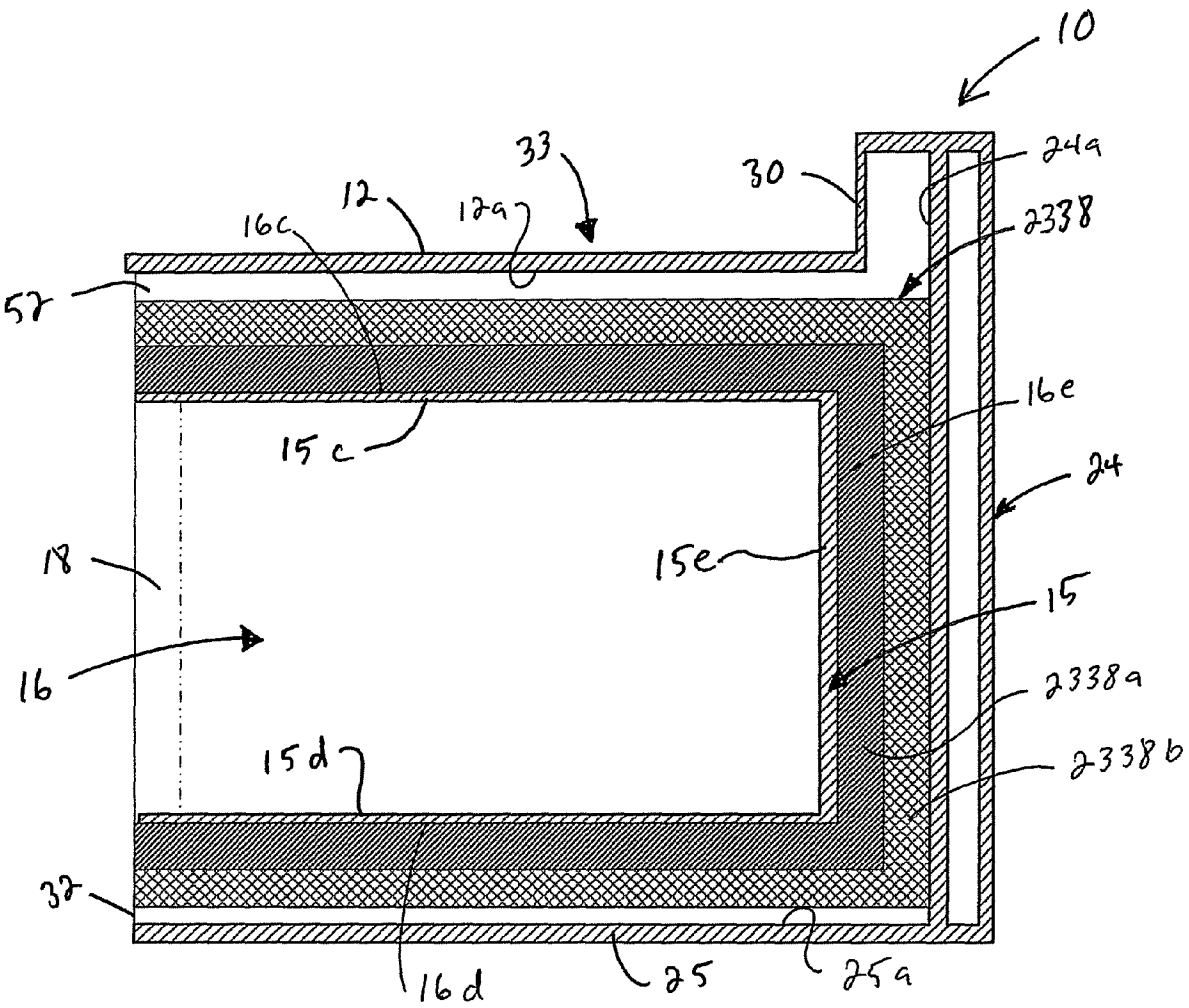
FIG. 27 is a view similar to FIG. 3 of an oven having the insulation layers shown in FIG. 26.
Figure 28:
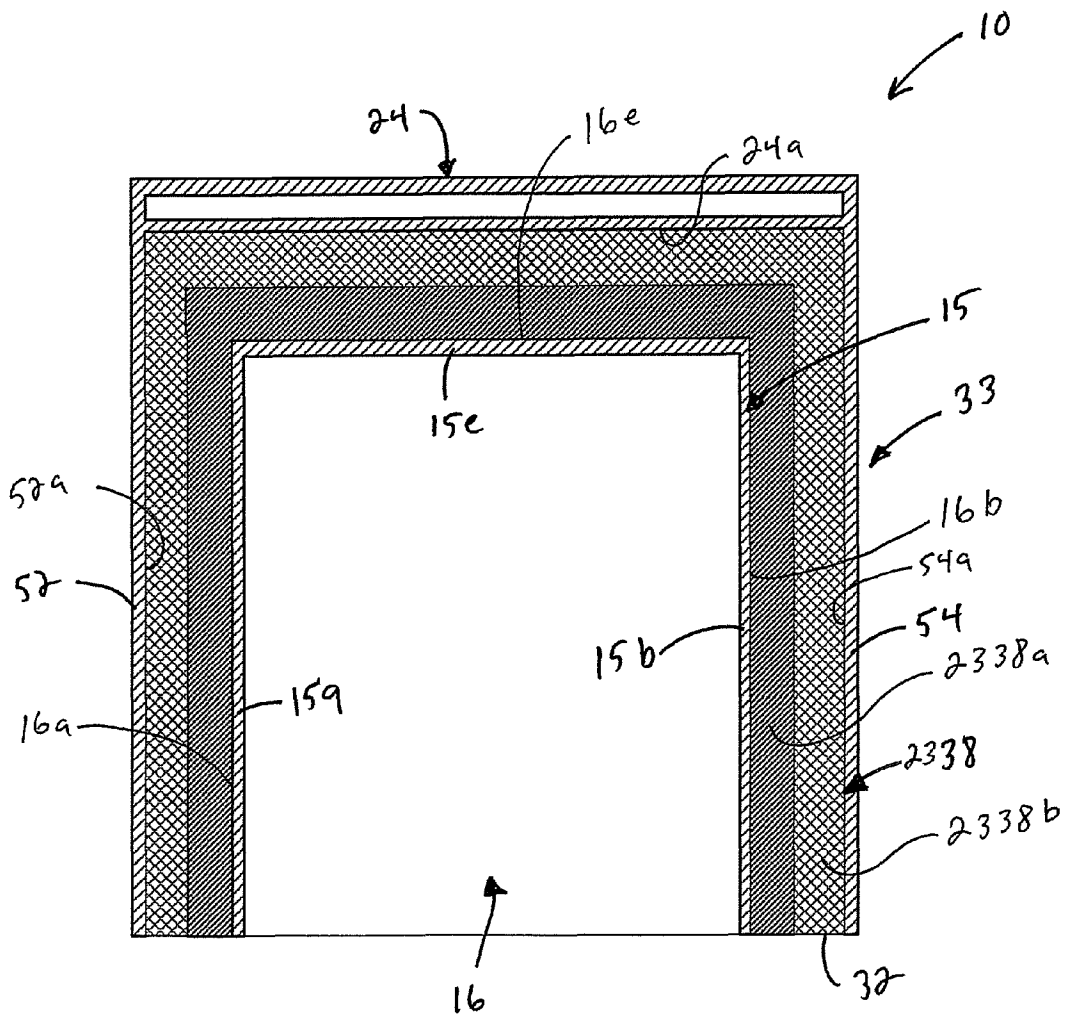
FIG. 28 is a view similar to FIG. 25 of an oven having the insulation layers shown in FIG. 26.

Referring now to FIGS. 26-28, there is illustrated an improved thermal oven 10 that is similar to the embodiment illustrated by FIGS. 23-25, except the outer layer 2338*b* entirely fills the gaps between the inner layer 2338*a* and one or more of the inside surfaces 52*a*, 54*a*, 25*a*, 24*a* and 12*a* of the opposed side panels, back panel, bottom pane and cooking surface 52, 54, 25, 24 and 12 respectively of the outer cabinet 33. As in the embodiment illustrated by FIGS. 23-25, the inner insulation material 2338*a* is a high density insulation and is configured to provide a predetermined level of thermal insulation. The inner insulation material 2338*a* has a thickness t1. In one embodiment, the thickness t1 is in a range from about 0.50 inches (1.27 cm) to about 1.5 inches (3.81 cm). In another embodiment, the thickness t1 can be less than 0.50 inches (1.27 cm) or more than 1.5 inches (3.81 cm). In one embodiment, the inner insulation material 2338*a* has a density in a range from about 1.0 lb/ft^3 to about 15.0 lb/ft^3. In another embodiment, the inner fibrous insulation material 2338*a* can have a density less than 1.0 lb/ft^3 or more than 15.0 lb/ft^3.

As in the embodiment illustrated by FIGS. 23-25, the outer insulation material layer 2338*b* is low density insulation in the embodiment illustrated by FIGS. 26-28. However, in the example illustrated by FIGS. 26-28 the outer insulation layer 2338*b* is configured to replace the entire air gap 36 with a semi-transparent thermal insulation. This low density, semi-transparent outer insulation layer 2338*b* prevents the high density layer 2338*b* from contacting the outer housing and thereby prevents hot spots due to conduction from the high density layer 2338*b* to the housing 33. In the embodiment illustrated by FIGS. 26-28, the outer insulation material layer 2338*b* has a thickness t3, which is equal to or slightly greater than the distance d3 between outside surface of the inner insulation layer 2338*a* and the inside surface 52*a*, 54*a*, 25*a*, 24*a* and 12*a* of the opposed side panels, back panel, bottom pane and cooking surface 52, 54, 25, 24 and 12 respectively. The outer layer of insulation material 2338*b* need not contact all of the opposed side panels, back panel, bottom panel and cooking surface 52, 54, 25, 24 and 12. In one exemplary embodiment, for the panels that are not contacted, the outer insulation layer 2338*b* has a thickness t2 is in a range from about 0.50 inches (1.27 cm) to about 1.5 inches (3.81 cm). In another embodiment, the thickness t2 can be less than 0.50 inches (1.27 cm) or more than 1.5 inches (3.81 cm).

Figure 29:
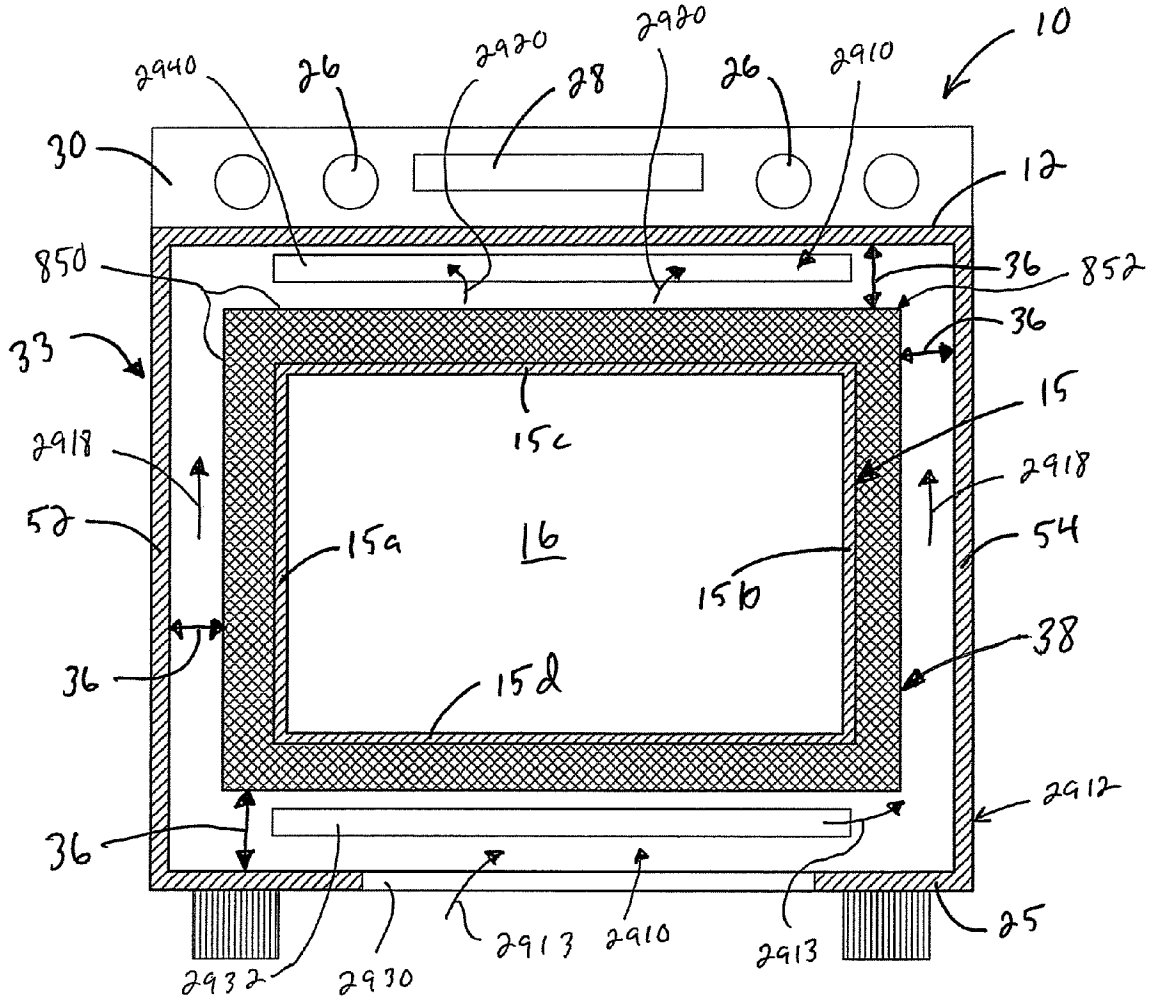
FIG. 29 is a view similar to the view illustrated by FIG. 2 of an exemplary embodiment of an oven with convection airflow management features.
Figure 30:
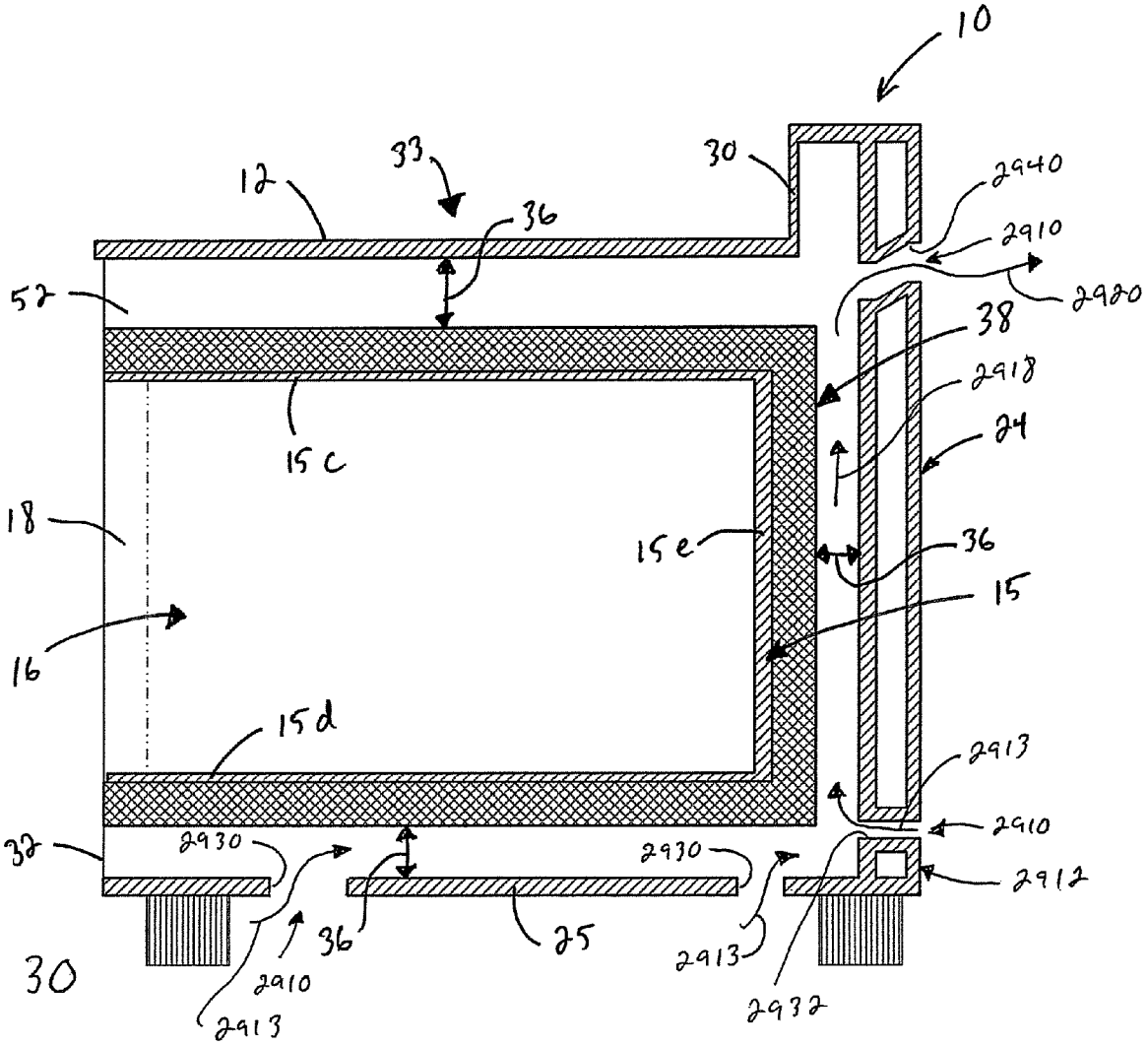
FIG. 30 is a view similar to FIG. 3 of an oven having the convection airflow management features of FIG. 29.

FIGS. 29 and 30 illustrate an exemplary embodiment of a of a thermal oven 10 with convection airflow management features 2910. In the exemplary embodiment illustrated by FIGS. 29 and 30, the airflow management features 2910 minimize outer surface temperatures by drawing air into a bottom portion 2912 of the outer cabinet 33 as indicated by arrows 2913, channeling that air through the gap 36 along the sides 52, 54 and back 24 of the thermal oven 10 as indicated by arrows 2918, and out the back 24 of the oven as indicated by arrows 2920. This controlling of the convective airflow reduces the maximum temperature of the outer cabinet 33 below a maximum allowable outside surface temperature of the oven 10. In addition to providing strategically located openings to the exterior, the air gap 38 spaces and channels are configured to manage the convective airflow.

In the example illustrated by FIGS. 29 and 30, air intake openings 2930 are provided in the bottom wall and/or air intake openings 2932 are provided in a lower portion of the rear wall. Air outlet openings 2940 are provided in an upper portion of the rear wall. However, a wide variety of different intake and outlet configurations can be employed. In the example illustrated by FIGS. 29 and 30, gaps 36 are provided between the insulation 38 and the opposed side panels 52, 54 and between the insulation 38 and the back panel 25. However, the gaps 36 can be provided between the insulation 38 and any of the panels of the outer cabinet 33. In an exemplary embodiment, the size of the gaps is selected to keep the maximum temperature of the outer cabinet 33 below a maximum allowable outside surface temperature of the oven 10.

The thermal management features disclosed in this application can be used in a wide variety of different types and configurations of ovens 10. The thermal management features have been generally described with reference to a conventional single oven. However, the thermal management features disclosed by this application can be used with any type of oven, such as the double oven 3110 shown in FIGS. 31-33.

The double oven 3110 can take a wide variety of different forms. In the example illustrated by FIGS. 31-33, the double oven 3110 includes a substantially flat, top cooking surface 12. A plurality of heating elements or burners 14 are typically positioned on the top cooking surface 12, although the heating elements or burners 14 are optional. The double oven 3110 includes a plurality of controls 26 for the burners 14 on the cooking surface as well as a control panel 28 for controlling the temperatures within oven cavities 3116, 3117.

Figure 31:
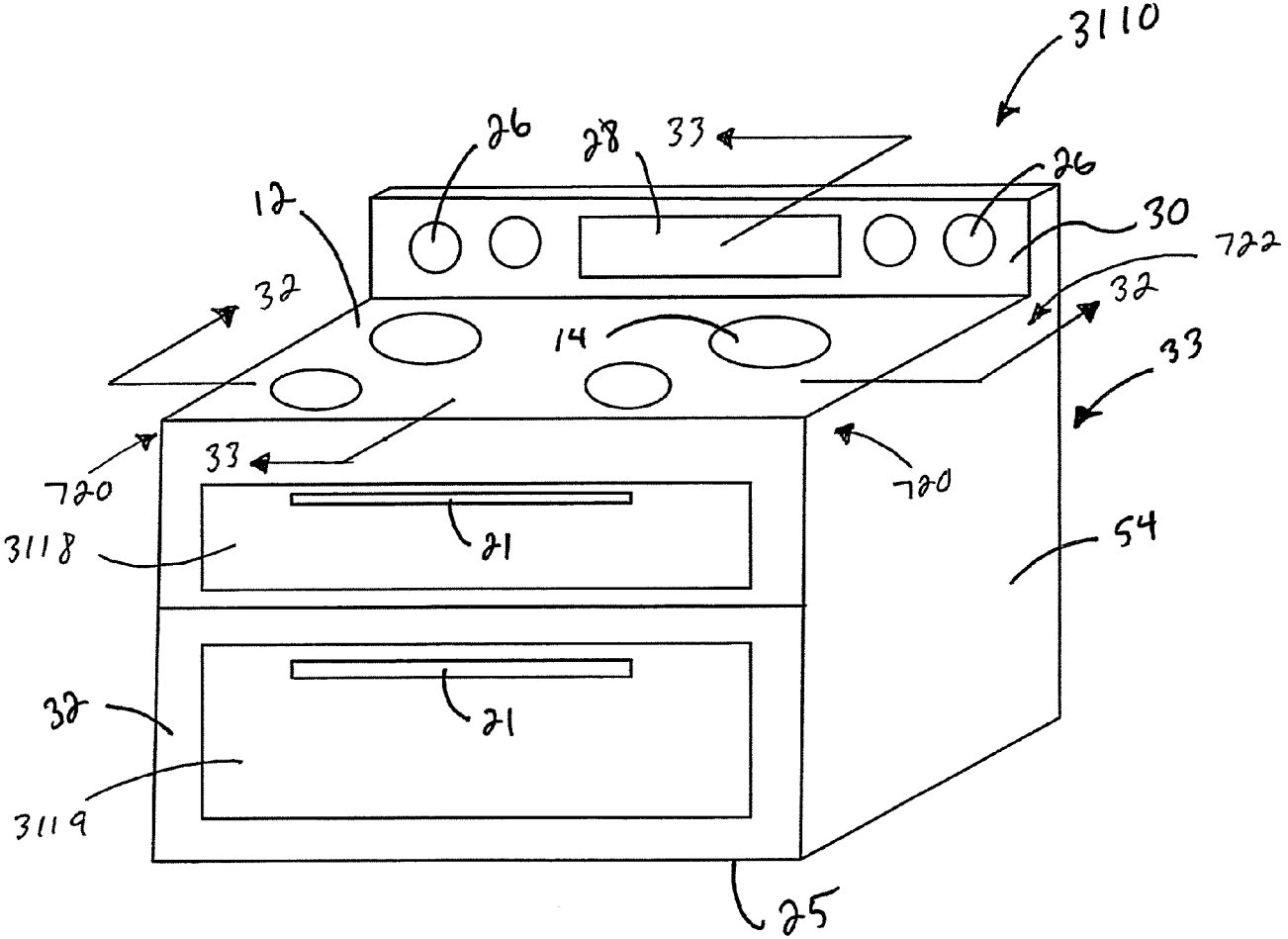
FIG. 31 is a perspective view of a thermal oven.
Figure 32:
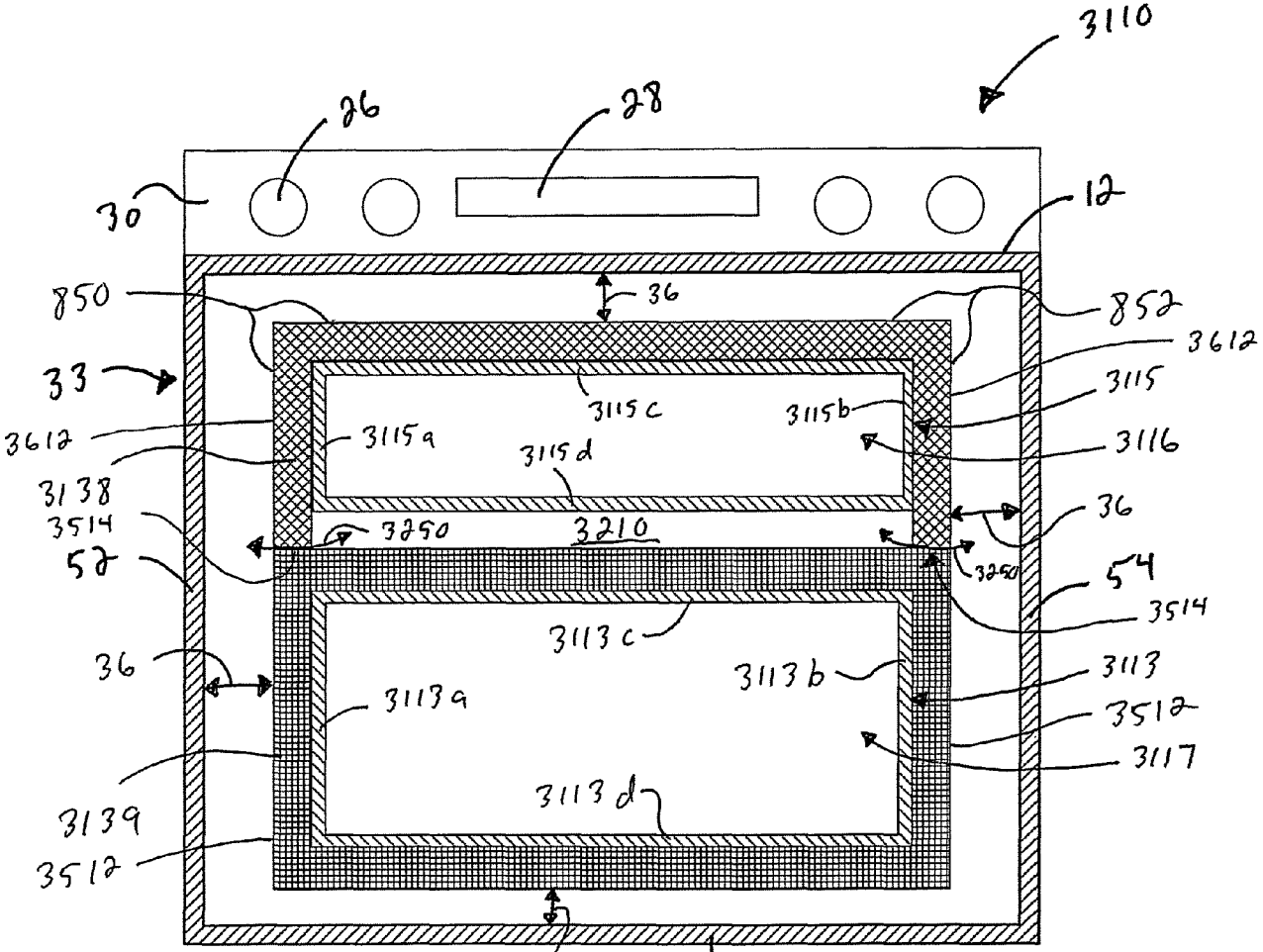
FIG. 32 is a cross-sectional view taken along the plane indicated by lines 32-32 in FIG. 31 illustrating an oven cavity.
Figure 33:
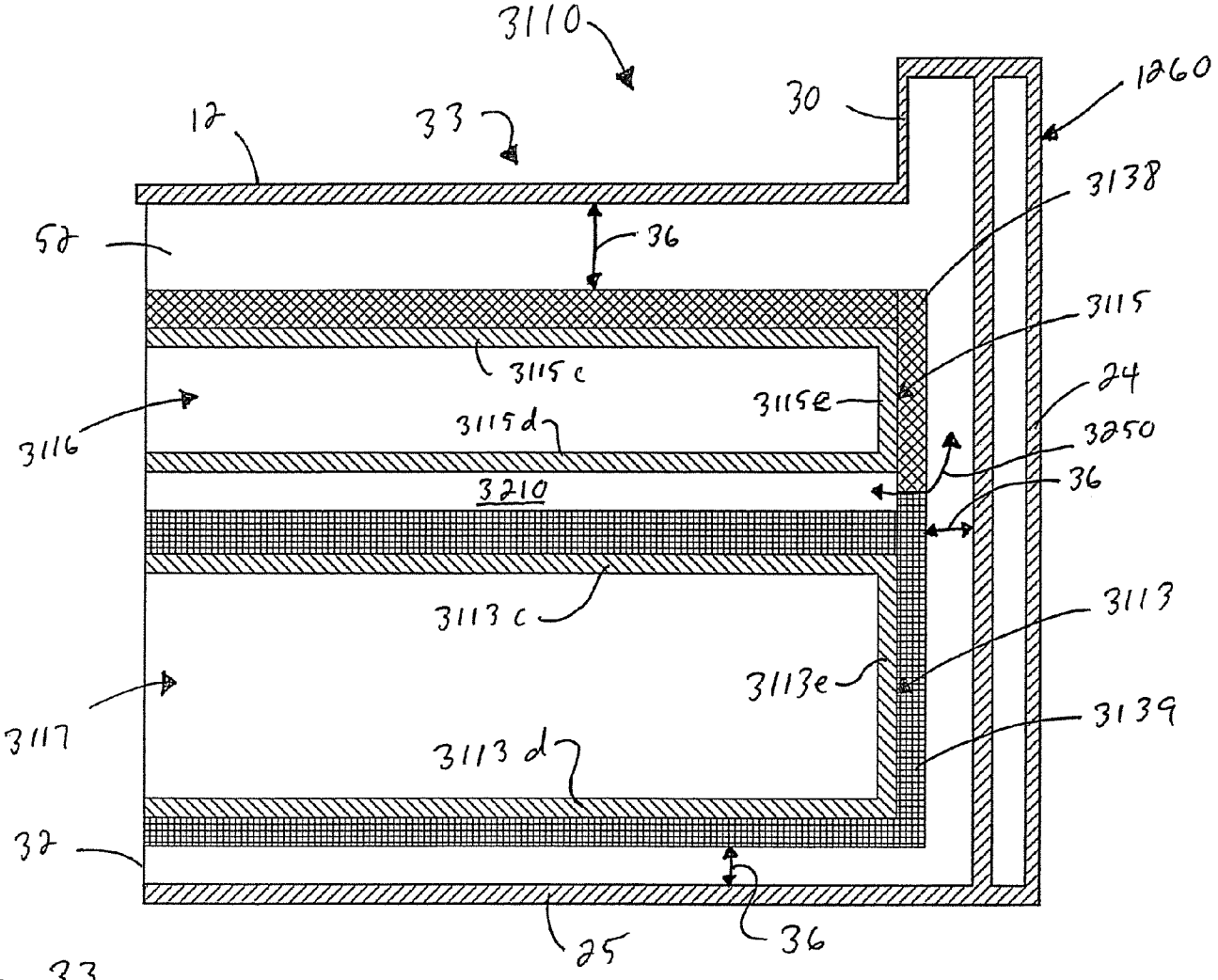
FIG. 33 is a cross-sectional view taken along the plane indicated by lines 33-33 in FIG. 31.

As shown in FIGS. 31-33, the double oven 3110 includes a pair of opposed side panels 52 and 54, a back panel 24, a bottom panel 25, and a front panel 32. The opposed side panels 52 and 54, back panel 24, bottom panel 25, front panel 32 and cooking surface 12 are configured to form an outer oven cabinet 33.

The front panel 32 includes upper and lower insulated oven doors 3118, 3119 pivotally connected to the front panel 32. The oven doors 3118, 3119 are hinged at a lower end to the front panel 32 such that the oven doors can be pivoted away from the front panel 32 and the oven cavities 3116, 3117.

As shown in FIGS. 32 and 33, the outer oven cabinet 33 supports an upper inner oven liner 3115 and a lower inner oven liner 3113. The upper inner oven liner 3115 includes opposing liner sides 3115*a* and 3115*b*, a liner top 3115*c*, a liner bottom 3115*d* and a liner back 3115*e*. The opposing liner sides 3115*a* and 3115*b*, liner top 3115*c*, liner bottom 3115*d*, liner back 3115*e* and oven door 3118 are configured to define the upper oven cavity 3116. The lower inner oven liner 3113 includes opposing liner sides 3113*a* and 3113*b*, a liner top 3113*c*, a liner bottom 3113*d* and a liner back 3113*e*. The opposing liner sides 3113*a* and 3113*b*, liner top 3113*c*, liner bottom 3113*d*, liner back 3113*e* and oven door 3119 are configured to define the lower oven cavity 3117.

As further shown in FIGS. 32 and 33, opposing liner sides 3115*a* and 3115*b*, the liner top 3115*c*, and a liner back 3115*e* of the top oven liner 3115 are covered by insulation material 3138. The lower oven liner is covered by insulation material 3139. A typical insulation material 3138, 3139 is fiberglass insulation, although other insulation material can be used. In one exemplary embodiment, the insulation material 3138 and/or 3139 is a binderless or dry binder fiberglass insulation material. For example, the fiberglass insulation material may be any of the insulation materials and/or may be formed by any of the processes described in U.S. patent application Ser. No. 13/632,895, titled "METHOD FOR FORMING A WEB FROM FIBROUS MATERIAL," filed on Oct. 1, 2013 and U.S. patent application Ser. No. 13/839,350, titled "METHOD FOR FORMING A WEB FROM FIBROUS MATERIAL," filed on Mar. 15, 2013, and which is a continuation-in-part of U.S. patent application Ser. No. 13/632,895, both of which are incorporated herein by reference in their entirety.

As shown in FIGS. 32 and 33, an air gap 36 is formed between the insulation material 3138, 3139 and the outer oven cabinet 33. The air gap 36 is used as a further insulator to limit the conductive heat transfer between oven liners 3115, 3113 and the outer oven cabinet 33. The use of the air gap 36 supplements the insulation material 3138, 3139 to minimize the surface temperatures on the outer surfaces of the outer oven cabinet 33.

During normal cooking operation, the double oven 3110 will heat the oven cavities 3116, 3117 to cooking temperature ranges from about 250.degree. F. (121.degree. C.) to about 500.degree. F. (260.degree. C.). When operating in a self-cleaning mode, the double oven 3110 heats the oven cavities 3116, 3117 to temperatures in a range from about 750.degree. F. (398.degree. C.) to about 900.degree. F. (482.degree. C.). Heat exposure tests, such as the UL858 Standard for Household Electric Ranges and ANSI Z21.1 Standard for Household Cooking Gas Appliances, require that the maximum allowable surface temperature be 152.degree. F. for a painted metal surface, 160.degree. F. for a porcelain enamel surface, or 172.degree. F. for a glass surface.

Referring to FIGS. 32 and 33, when the insulation 3138 is installed on the oven liner 3115 and the insulation 3139 is installed on the oven liner 3113, a gap 3210 is formed between the insulation 3139 and the oven liner 3115. Air in the gap 3210 is heated by the oven liner 3115, may flow out of the gap 3210 and/or be drawn into the gap as indicated by arrow 3250, and heat an interior surface of the outer oven cabinet 33. For example, the heated air from the gap 3210 may heat an upper surface 1260 of the back panel 24 and cause a hotspot at that location. However, the heated air from the gap 3210 may cause one or more hotspot at any location or locations of the outer oven cabinet 33.

Figure 34:
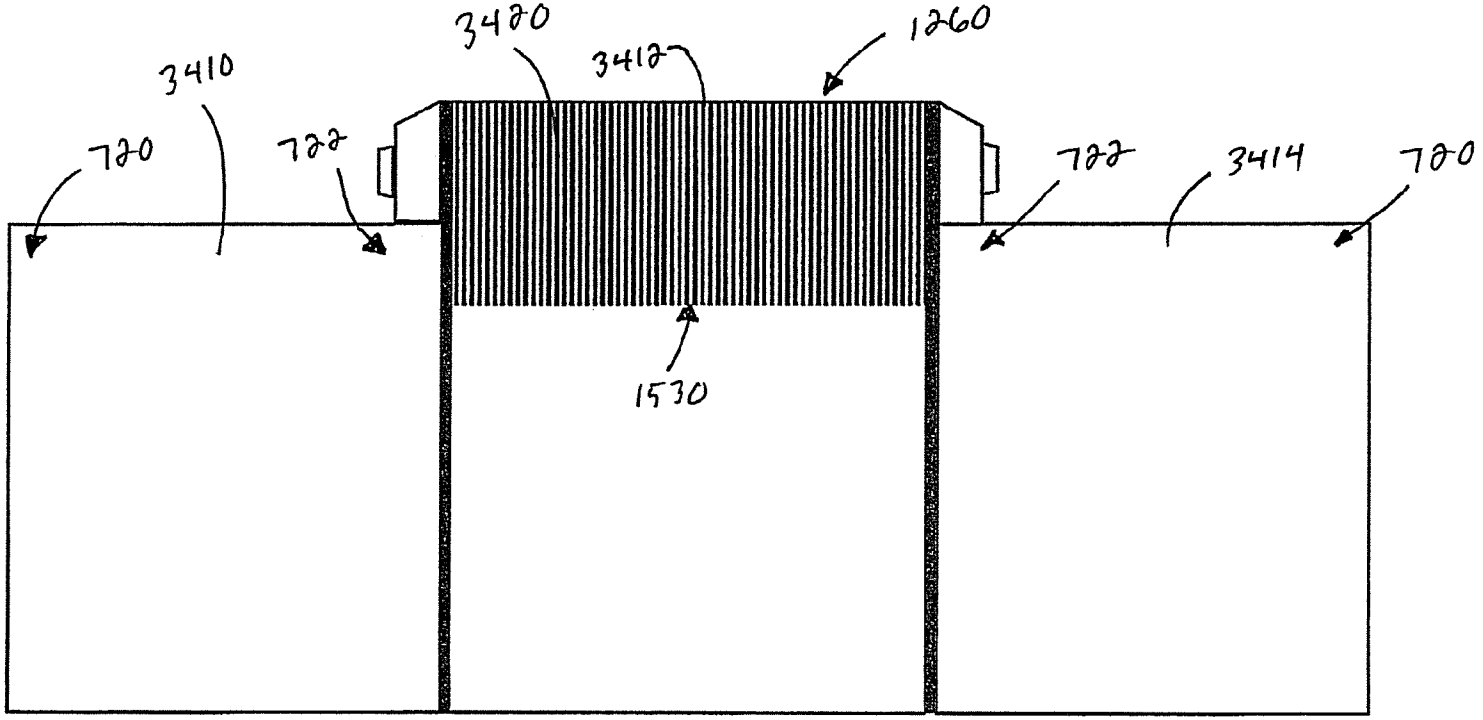
FIG. 34 is a schematic illustrations showing thermal measurements taken of the oven shown in FIGS. 31-33.

FIG. 34 is a schematic illustration showing thermal measurements taken during a test of the double oven 3110 with a gap 3210 as shown in FIG. 32-14 in the test fixture 410 of FIGS. 4-6. In FIG. 34, portion 3410 represents thermal measurements of a right side of the oven 3110, portion 3412 represents thermal measurements of the back panel 24, and portion 3414 represents thermal measurements of the left side of the oven 3110. Shaded areas 3420 represent hot spots at an upper portion 1530 of the back panel 24 an oven 3110 having the gaps 3410 illustrated by FIG. 34 during thermal testing in the fixture 410.

Figure 35:
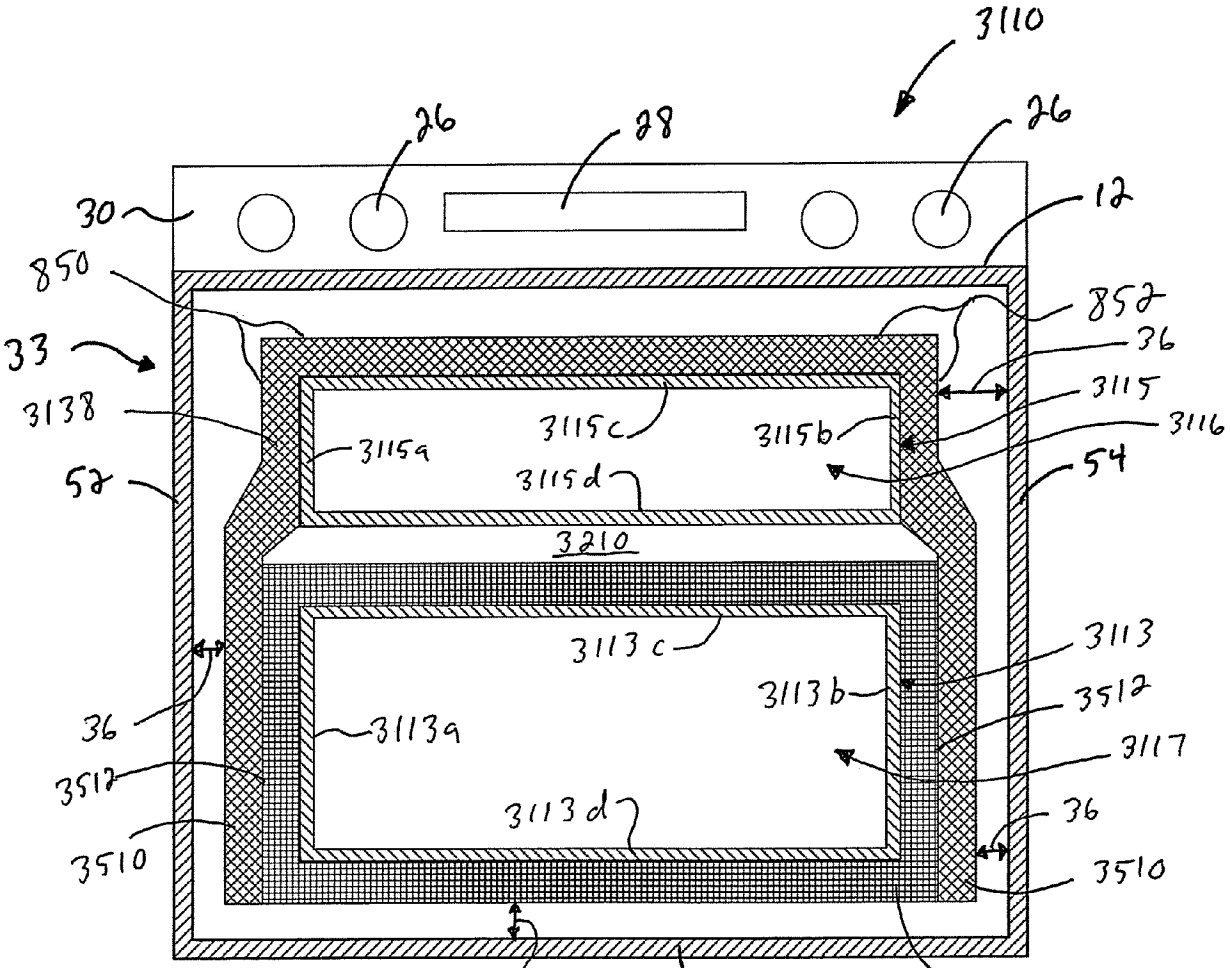
FIG. 35 is a perspective view of an oven similar to the oven illustrated by FIG. 31 with upper oven insulation extensions.
Figure 36:
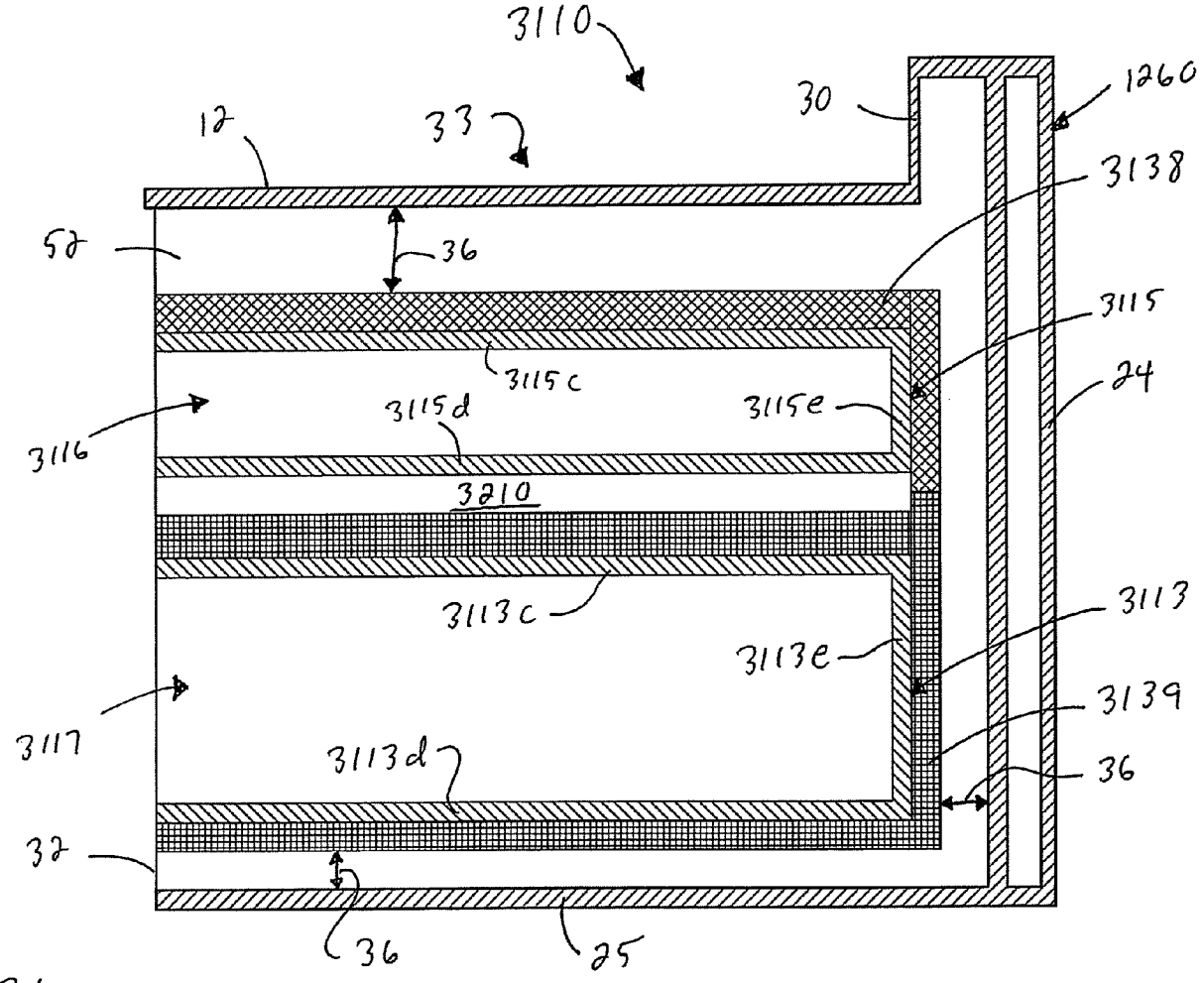
FIG. 36 is a cross-sectional view of the oven illustrated by FIG. 35 taken along the plane indicated by lines 33-33 in FIG. 31.

FIGS. 35 and 36 illustrate an exemplary embodiment of a double oven 3110 having insulation 3138 with extensions 3510 that cover the sides 3512 of the insulation 3139. The extensions prevent or inhibit air from being drawn into the gap 3210 and/or out of the gap through an interface 3514 (See FIGS. 32 and 33) between the sides 3512 of the insulation 3139 and sides 3612 of the insulation 3138. In an exemplary embodiment, the air gap 36 is maintained between the extensions 3510 and the cabinet 33 as shown in FIG. 35. In an alternate embodiment, the extensions 3510 may be configured to engage the cabinet, such that there is no gap 36. By preventing or inhibiting air from being drawn into the gap 3210 and/or out of the gap, hotspots due to air heated in the gap 3210 are reduced or eliminated.

Air can be prevented or inhibited from being drawn into the gap 3210 and/or out of the gap through the interface 3514 between the sides 3512 of the insulation 3139 and sides 3612 of the insulation 3138 in a variety of ways other than providing the extensions 3510. For example, the interface 3514 between the sides can be sealed and/or secured together, the gap 3210 can be filled, for example with additional insulation, and/or extensions of the lower insulation 3139 can extend up along sides 3612 of the insulation 3138.

Figure 37:
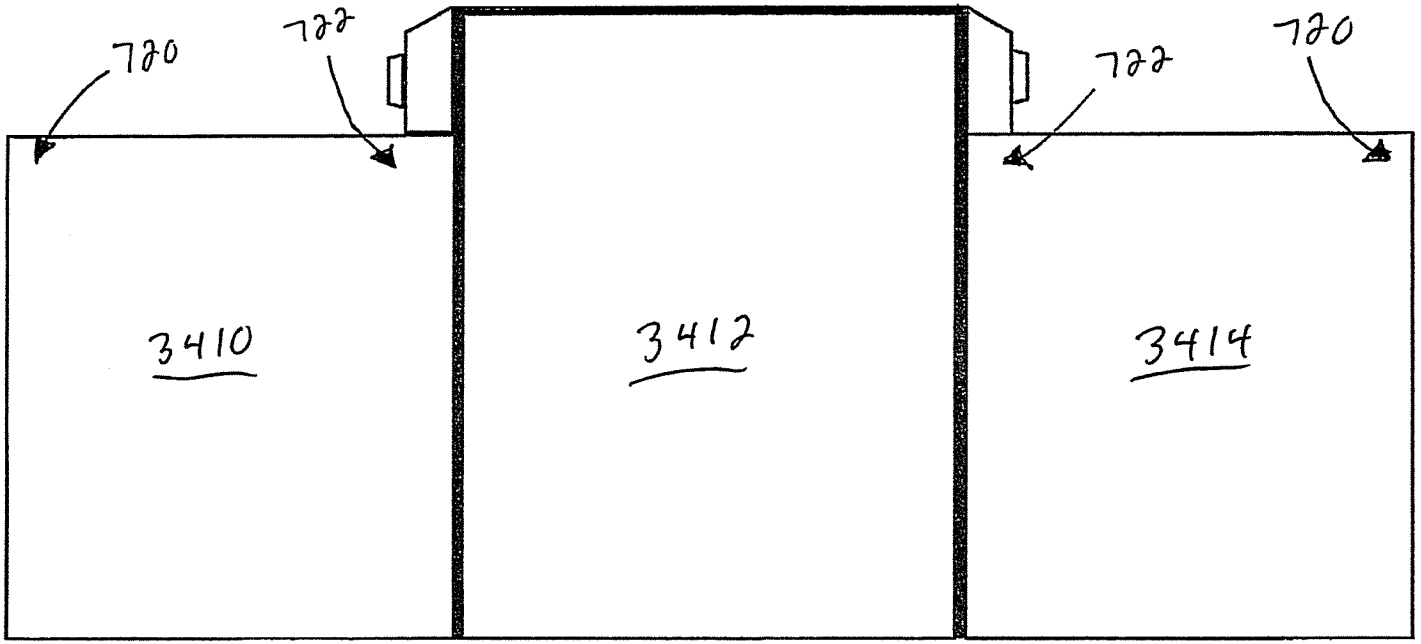
FIG. 37 is a view similar to FIG. 34 illustrating the effect of the insulation extensions shown in FIG. 35.

FIG. 37 is a schematic illustrations similar to FIG. 34 showing thermal measurements taken during a test of a double oven 10 where air is prevented or inhibited from being drawn into the gap 3210 and/or out of the gap through the interface 3514 in the test fixture 410 of FIGS. 4-6. For example, FIG. 7 is representative of a test of the double oven 3110 illustrated by FIGS. 35 and 36. As can be seen from FIGS. 34 and 37, the hot spots at the upper portion 1530 of the back panel 24 during thermal testing in the fixture 410 are reduced or eliminated.

Figure 38:
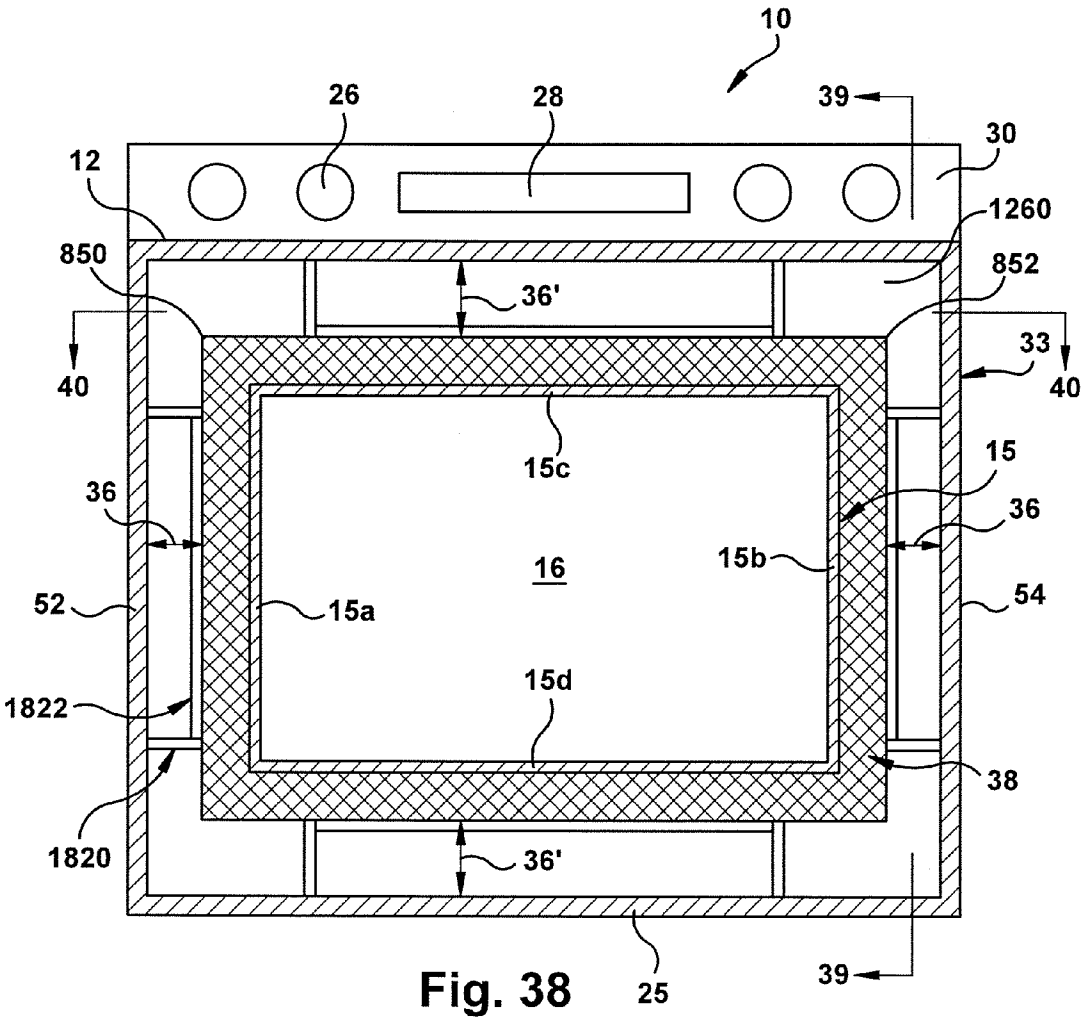
FIG. 38 is a view similar to the views of FIG. 18 where the oven includes standoffs and retaining elements that prevent gaps between the insulation and the oven liner and prevent the insulation from making contact with the outer over cabinet.
Figure 39:
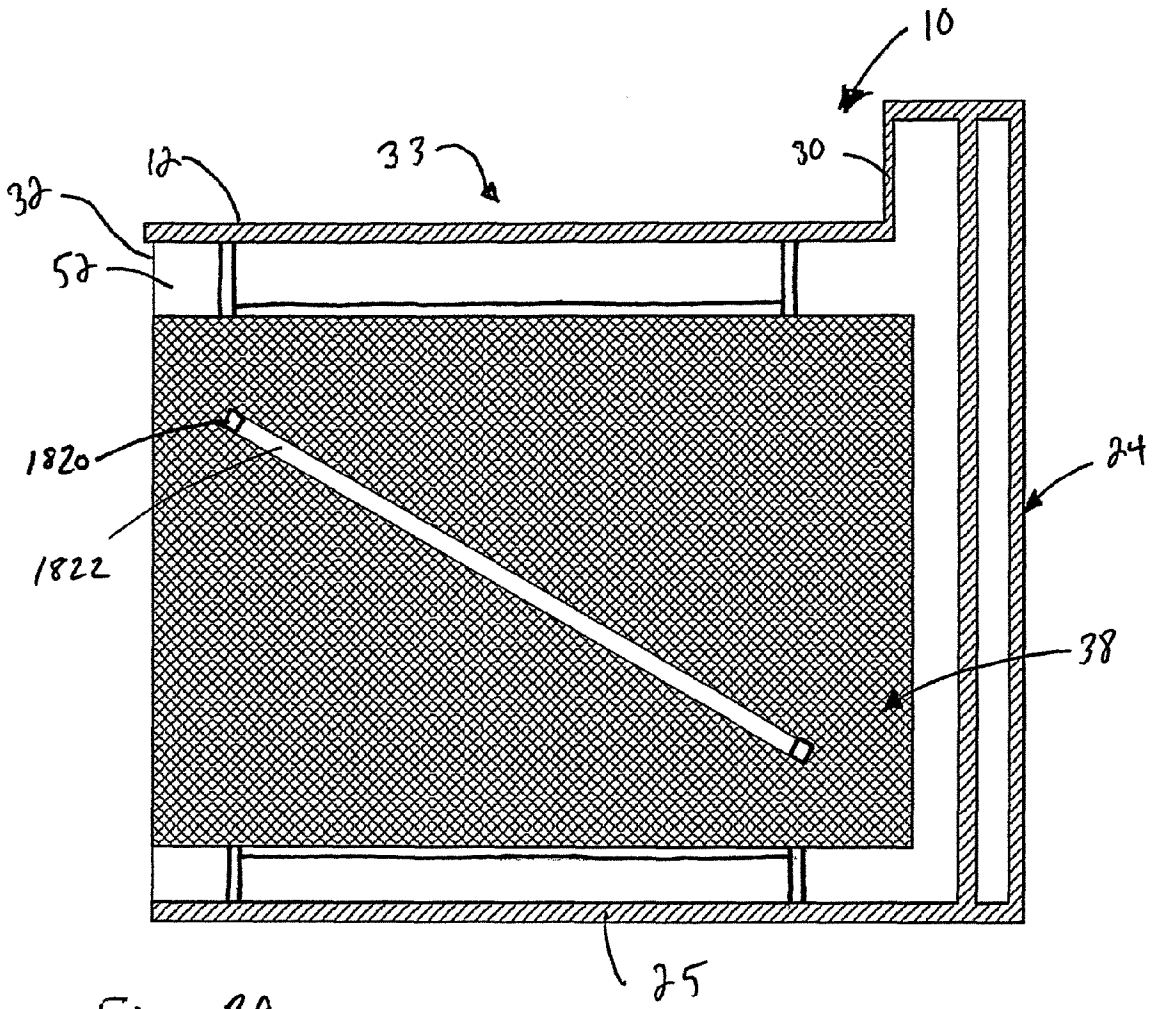
FIG. 39 is a sectional view taken along the plane indicated by lines 39-39 in FIG. 38 showing standoffs and retaining elements illustrated by FIG. 38.
Figure 40:
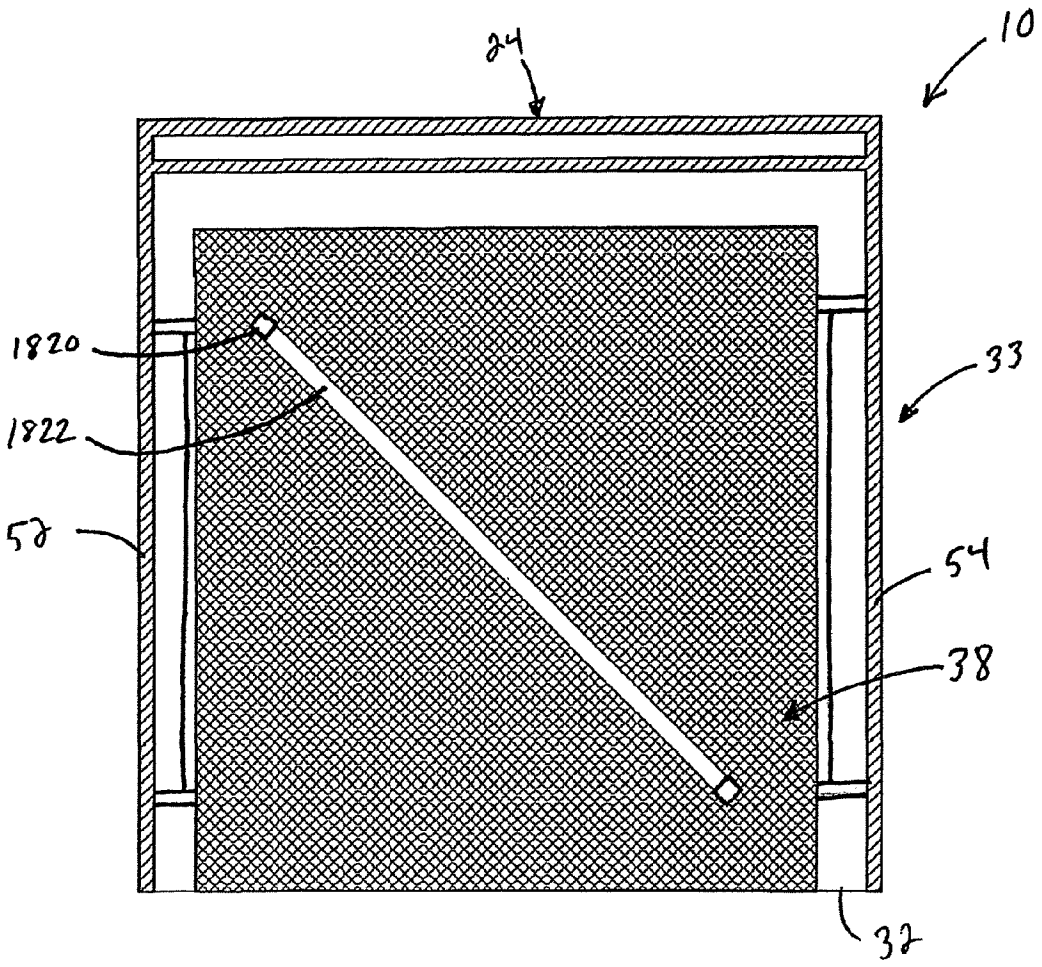
FIG. 40 is a sectional view taken along the plane indicated by lines 40-40 in FIG. 38 showing standoffs and retaining elements illustrated by FIG. 38.

FIGS. 38-40 illustrate an exemplary embodiment of an oven 10 with one or more standoffs 1820 with retaining elements 1822 that keep the insulation 38 in continuous contact with the oven liner 15 such that no gaps 1210 (See FIGS. 12-14) are formed between the oven liner 15 and/or that prevent the insulation 38 from contacting the outer cabinet 33. By eliminating the gaps 1210 and contact between the insulation 38 and the outer cabinet 33, hotspots due to air heated in the gap 1210 and contact between the insulation 38 and the cabinet 33 are reduced or eliminated.

The standoffs 1820 and retaining elements 1822 can take a wide variety of different forms. In the illustrated embodiment, the standoffs 1820 are posts provided at one or more of the sides of the outer cabinet 33. In the illustrated example, two posts are attached to each of the opposing side panels 52 and 54, the bottom panel 25, and the cooking surface 12. However, any number of posts can be provided on any of the opposing side panels 52 and 54, the bottom panel 25, and the cooking surface 12. In the illustrated embodiment, each pair of standoffs 1820 on a side of the outer cabinet 33 are connected by a retaining element 1822.

The standoffs 1820 can be made from a wide variety of different materials. In one exemplary embodiment, the standoffs 1820 are made from a material having a low thermal conductivity. By making the retainers from a material with a low thermal conductivity, heat that is conducted from the outside of the insulation 38, through the standoff 1820, and to the outer cabinet 33 is minimized. The standoffs 1820 can be positioned in a wide variety of different ways. In the illustrated examples, the standoffs 1820 are positioned such that the retaining elements 1822 connecting them are oriented at angles over the face of the insulation with a center of the retaining element positioned over the center of the insulation face. This orientation eliminates the gaps 1210 and contact between the insulation 38 and the outer cabinet 33. However, the standoffs and retaining elements can be positioned in a wide variety of different orientations than as shown.

The retaining elements 1822 can be made from a wide variety of different materials. In one exemplary embodiment, the retaining elements 1822 are made from stiff metal wire. In the illustrated example the metal wire forms a straight line between the two posts it is connected to. However, the retaining element may be formed into a wide variety of different shapes than as shown. For example, the retaining elements may be bent wire or other material, such that the retaining elements 1822 have point contact at a plurality of locations, rather than the continuous contact of a straight, elongated retaining element. For example, the wire may have a zig-zag shape similar to the shape of the ends of the standoffs 1830 illustrated by FIG. 41 and described below.

Figure 41:
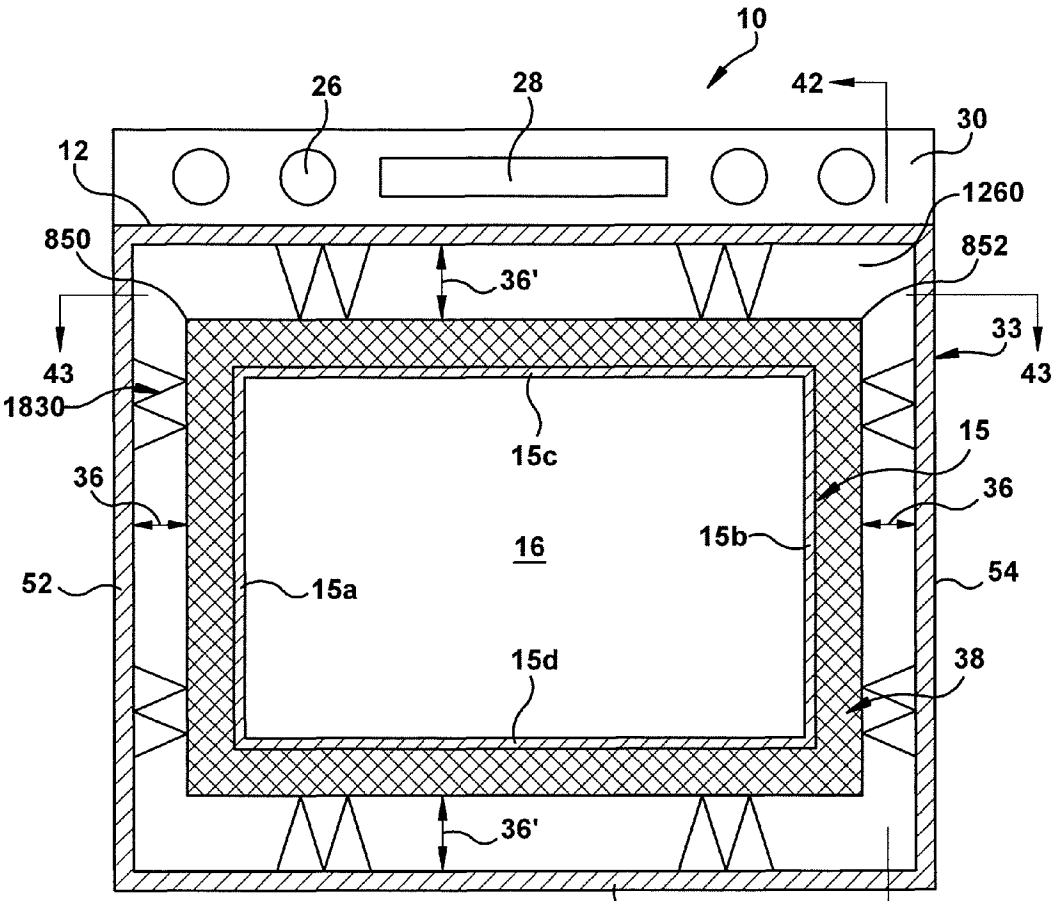
FIG. 41 is a view similar to the views of FIG. 18 where the oven includes "M" or "W" shaped standoffs that prevent gaps between the insulation and the oven liner and prevent the insulation from making contact with the outer over cabinet.
Figure 42:
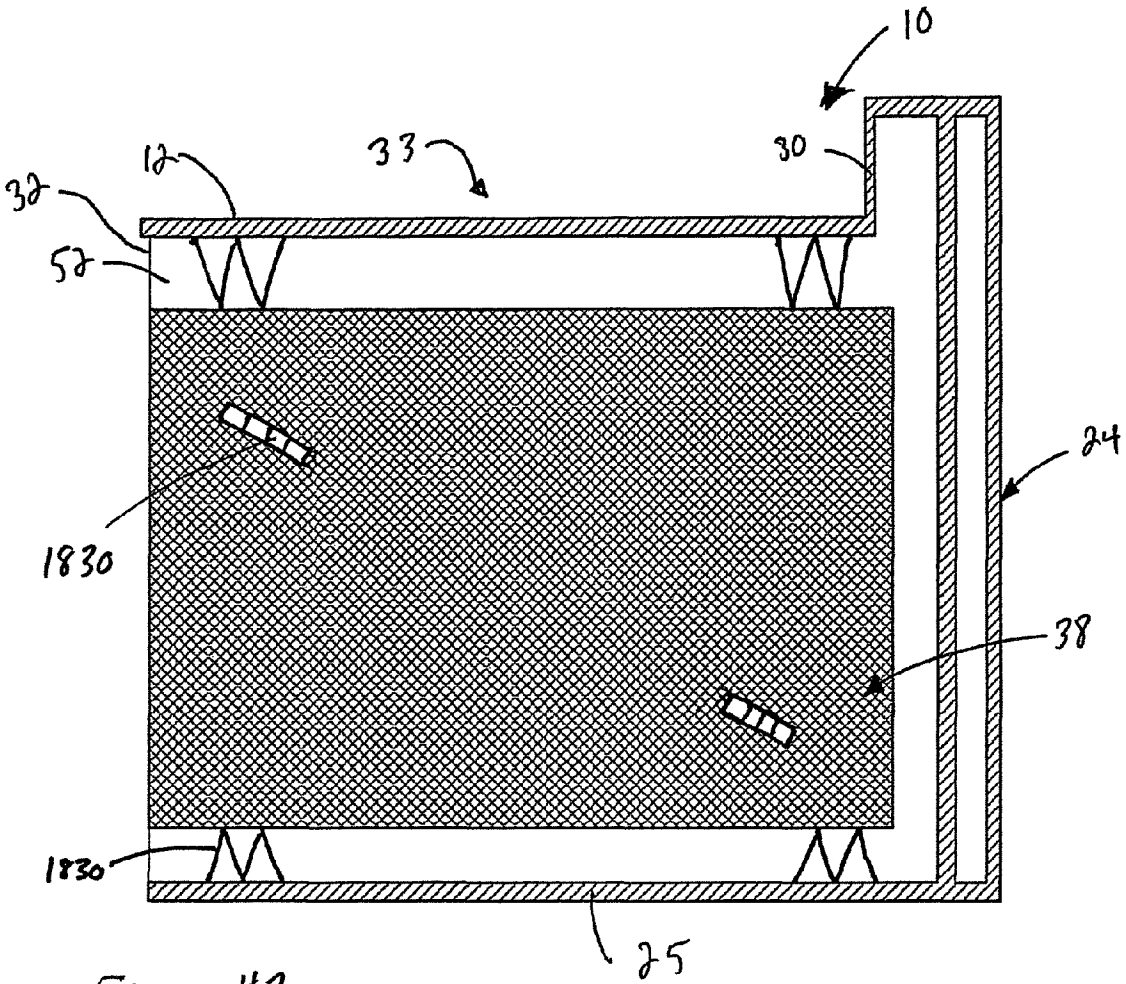
FIG. 42 is a sectional view taken along the plane indicated by lines 42-42 in FIG. 41 showing standoffs and retaining elements illustrated by FIG. 41.
Figure 43:
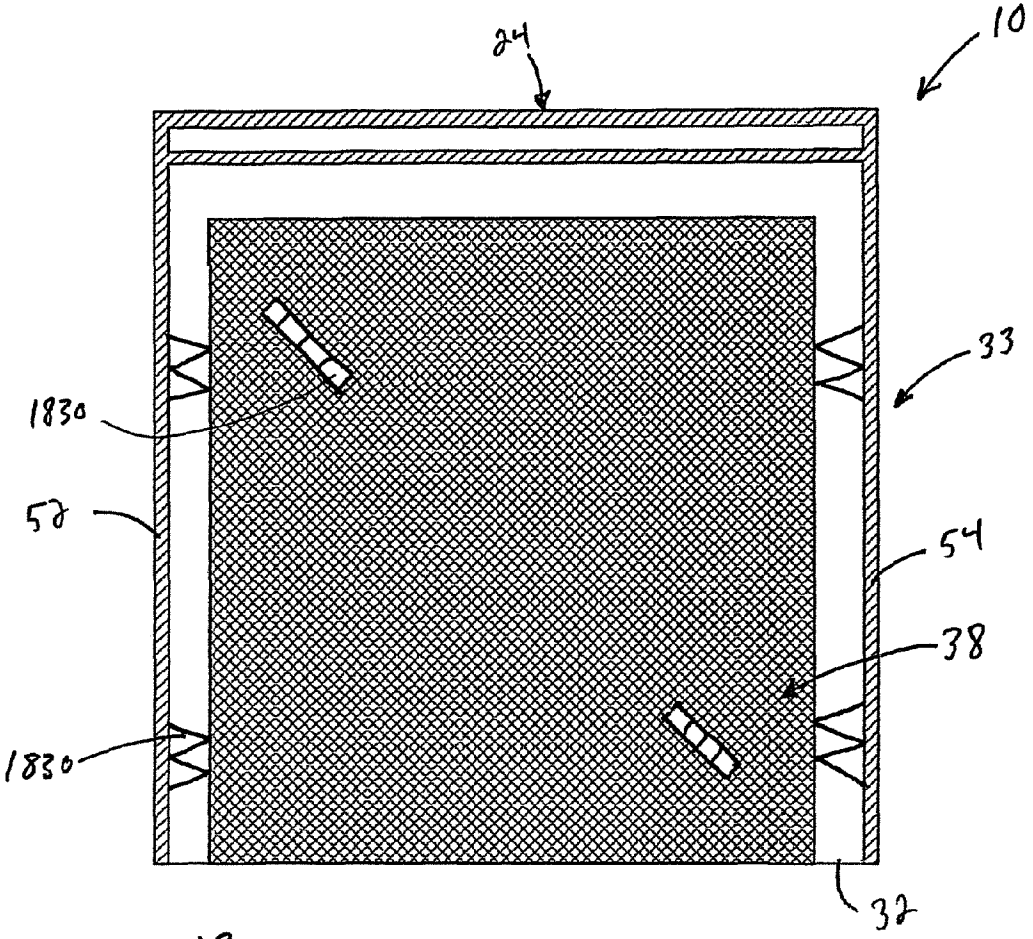
FIG. 43 is a sectional view taken along the plane indicated by lines 43-43 in FIG. 41 showing standoffs and retaining elements illustrated by FIG. 41.

FIGS. 41-43 illustrate an exemplary embodiment of an oven 10 with one or more "M" or "W" shaped standoffs 1830 that keep the insulation 38 in continuous contact with the oven liner 15 such that no gaps 1210 (See FIGS. 12-14) are formed between the oven liner 15 and/or that prevent the insulation 38 from contacting the outer cabinet 33. By eliminating the gaps 1210 and contact between the insulation 38 and the outer cabinet 33, hotspots due to air heated in the gap 1210 and contact between the insulation 38 and the cabinet 33 are reduced or eliminated. The standoffs 1830 may be attached to the outer cabinet 33 of the oven 10 or the insulation 38.

The standoffs 1830 can be made from a wide variety of different materials. In one exemplary embodiment, the standoffs 1830 are made from a material having a low thermal conductivity. By making the retainers from a material with a low thermal conductivity, heat that is conducted from the outside of the insulation 38, through the standoff 1830, and to the outer cabinet 33 is minimized. In the illustrated example, the standoffs 1830 are formed into an "M" or "W" shape, but the standoffs 1830 may be formed in a wide variety of different shapes than as shown.

The standoffs 1830 can be positioned in a wide variety of different ways. In the illustrated example, two standoffs 1830 are positioned on each of the opposing side panels 52 and 54, the bottom panel 25, and the cooking surface 12. The standoffs 1830 are shown positioned near the corner of the face of the insulation 38 that they are in contact with. However, any number of standoffs 1830 may be provided in any arrangement on each face of the outer cabinet 13.

Figure 44:
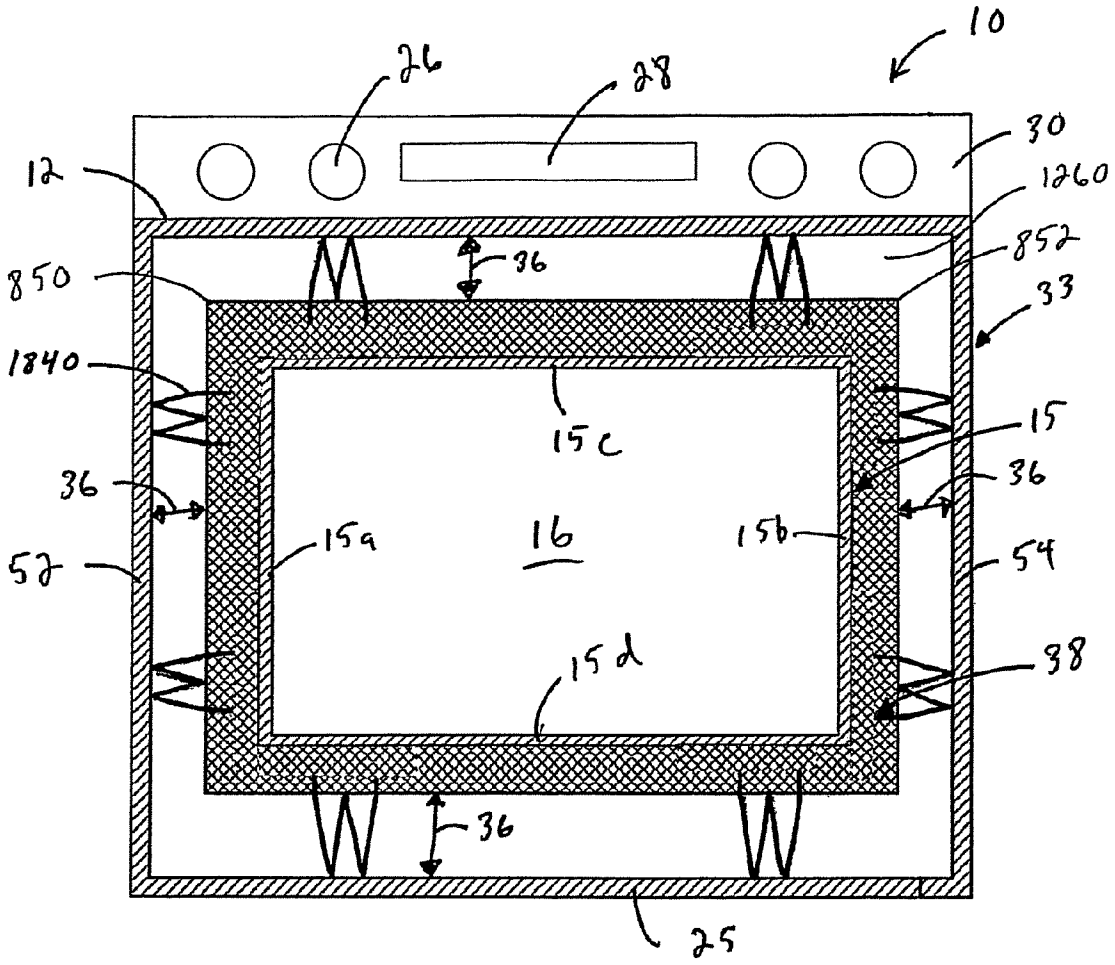
FIG. 44 is a view similar to the views of FIG. 18 where the oven includes "M" or "W" shaped standoffs attached through the insulation to the oven liner that prevent gaps between the insulation and the oven liner and prevent the insulation from making contact with the outer over cabinet.

FIG. 44 illustrates an exemplary embodiment of an oven 10 with one or more "M" or "W" shaped standoffs 1840 that keep the insulation 38 in continuous contact with the oven liner 15 such that no gaps 1210 (See FIGS. 12-14) are formed between the oven liner 15 and/or that prevent the insulation 38 from contacting the outer cabinet 33. By eliminating the gaps 1210 and contact between the insulation 38 and the outer cabinet 33, hotspots due to air heated in the gap 1210 and contact between the insulation 38 and the cabinet 33 are reduced or eliminated. The standoffs 1840 are attached to the liner 15 and pass through the insulation 38 to press against the outer cabinet 33 and against the insulation 38.

The standoffs 1840 can be made from a wide variety of different materials. In one exemplary embodiment, the standoffs 1840 are made from a material having a low thermal conductivity. By making the retainers from a material with a low thermal conductivity, heat that is conducted from the liner 15, through the standoff 1840, and to the outer cabinet 33 is minimized. In the illustrated example, the standoffs 1840 are formed into an "M" or "W" shape, but the standoffs 1840 may be formed in a wide variety of different shapes than as shown.

The standoffs 1840 can be positioned in a wide variety of different ways. In the illustrated example, two standoffs 1840 are positioned on each of the opposing liner sides 15*a* and 15*b*, the liner top 15*c*, and the liner bottom 15*d*. The standoffs 1840 are shown positioned near the corner of each of the liner sides that they are attached to. However, any number of standoffs 1840 may be provided in any arrangement on each face of the liner 15.

The present application discloses several different embodiments of thermal appliances, such as ovens 10, with features that keep the maximum temperature of the outer cabinet 33 below a maximum allowable outside surface temperature of the oven 10. Any of the features of any of the embodiments disclosed in this application can be combined with any of the features of any of the other embodiments disclosed by this application. Additional exemplary embodiments of the present application comprise combinations and subcombinations of the features of the exemplary embodiments described above.

What is claimed is:

1. A thermal appliance comprising:

an enclosure having an inner surface and an outer surface;

a heating compartment within the enclosure, the heating compartment having an inner surface and an outer surface, wherein the inner surface and the outer surface of the heating compartment are defined by a liner top, a liner bottom, a liner back, and two opposing liner sides;

insulating material disposed between the outer surface of the heating compartment and the inner surface of the enclosure; and a plurality of retainers attached to at least one of the heating compartment and the insulating material, wherein the retainers eliminate all air gaps between the insulating material and the outer surface of the heating compartment and prevent any portion of the insulating material from touching the inner surface of the enclosure, wherein the retainers are spaced apart from the enclosure and made of metal, and wherein each of the retainers is connected to a first location and a second location on a side liner of the heating compartment;

wherein a face of the insulating material has a top edge, a bottom edge, and two opposing side edges; wherein an axis extends along a length of the retainers; and wherein at least one of the retainers is positioned over the face of the insulating material such that the axis is not perpendicular to the top edge, the bottom edge, and the two opposing side edges.

2. The thermal appliance of claim 1, wherein the retainers are attached only to the heating compartment.

3. The thermal appliance of claim 1, wherein the retainers are clips.

4. The thermal appliance of claim 1, wherein a center of at least one of the retainers is positioned over a center of the face of the insulating material.

5. The thermal appliance of claim 1, wherein no retainers are provided at one or more of the liner top, the liner bottom, the liner back, and the liner sides.

6. A thermal appliance comprising:

an enclosure having an inner surface and an outer surface;

a heating compartment within the enclosure, the heating compartment having an inner surface and an outer surface, wherein the inner surface and the outer surface of the heating compartment are defined by a liner top, a liner bottom, a liner back, and two opposing liner sides;

insulating material disposed between the outer surface of the heating compartment and the inner surface of the enclosure such that an air gap is provided adjacent to a bottom surface of the insulating material; and a plurality of retainers attached to at least one of the heating compartment and the insulating material, wherein the retainers eliminate all air gaps between the insulating material and the outer surface of the heating compartment and prevent any portion of the insulating material from touching the inner surface of the enclosure, wherein the retainers are spaced apart from the enclosure and made of metal wire, and wherein each of the retainers is connected to a first location and a second location on a liner side of the heating compartment.

7. The thermal appliance of claim 6, wherein the retainers are attached only to the heating compartment.

8. The thermal appliance of claim 6, wherein the retainers are clips.

9. The thermal appliance of claim 6, wherein a face of the insulating material has a top edge, a bottom edge, and two opposing side edges; wherein an axis extends along a length of the retainers; and wherein at least one of the retainers is positioned over the face of the insulating material such that the axis is not perpendicular to the top edge, the bottom edge, and the two opposing side edges.

10. The thermal appliance of claim 9, wherein a center of at least one of the retainers is positioned over a center of the face of the insulating material.

11. The thermal appliance of claim 6, wherein no retainers are provided at one or more of the liner top, the liner bottom, the liner back, and the liner sides.

12. A thermal appliance comprising:

an enclosure having an inner surface and an outer surface;

a heating compartment within the enclosure, the heating compartment having an inner surface and an outer surface;

insulating material disposed between the outer surface of the heating compartment and the inner surface of the enclosure; and a plurality of retainers attached only to the heating compartment, wherein the retainers eliminate all air gaps between the insulating material and the outer surface of the heating compartment and prevent any portion of the insulating material from touching the inner surface of the enclosure, wherein the retainers are spaced apart from the enclosure;

wherein a face of the insulating material has a top edge, a bottom edge, and two opposing side edges; wherein an axis extends along a length of the retainers; and wherein at least one of the retainers is positioned over the face of the insulating material such that the axis is not perpendicular to the top edge, the bottom edge, and the two opposing side edges.

13. The thermal appliance of claim 12, wherein the retainers are clips.

14. The thermal appliance of claim 12, wherein the retainers are made of a material with a low thermal conductivity.

15. The thermal appliance of claim 12, wherein a center of at least one of the retainers is positioned over a center of the face of the insulating material.

16. The thermal appliance of claim 12, wherein the inner surface and the outer surface of heating compartment are defined by a liner top, a liner bottom, a liner back, and two opposing liner sides; and wherein no retainers are provided at one or more of the liner top, the liner bottom, the liner back, and the liner sides.

17. A thermal appliance comprising:

an enclosure having an inner surface and an outer surface;

a heating compartment within the enclosure, the heating compartment having an inner surface and an outer surface;

insulating material disposed between the outer surface of the heating compartment and the inner surface of the enclosure; and a plurality of retainers attached to at least one of the heating compartment and the insulating material, wherein the retainers eliminate all air gaps between the insulating material and the outer surface of the heating compartment and prevent any portion of the insulating material from touching the inner surface of the enclosure, wherein the retainers are spaced apart from the enclosure, and wherein the retainers are clips;

wherein a face of the insulating material has a top edge, a bottom edge, and two opposing side edges; wherein an axis extends along a length of the retainers; and wherein at least one of the retainers is positioned over the face of the insulating material such that the axis is not perpendicular to the top edge, the bottom edge, and the two opposing side edges.

18. The thermal appliance of claim 17, wherein the retainers are made of a material with a low thermal conductivity.

19. The thermal appliance of claim 17, wherein a center of at least one of the retainers is positioned over a center of the face of the insulating material.

20. The thermal appliance of claim 17, wherein the inner surface and the outer surface of heating compartment are defined by a liner top, a liner bottom, a liner back, and two opposing liner sides; and wherein no retainers are provided at one or more of the liner top, the liner bottom, the liner back, and the liner sides.

21. A thermal appliance comprising:

an enclosure having an inner surface and an outer surface;

a heating compartment within the enclosure, the heating compartment having an inner surface and an outer surface;

insulating material disposed between the outer surface of the heating compartment and the inner surface of the enclosure such that an air gap is provided adjacent to a bottom surface of the insulating material; and a plurality of retainers attached only to the heating compartment, wherein the retainers eliminate all air gaps between the insulating material and the outer surface of the heating compartment and prevent any portion of the insulating material from touching the inner surface of the enclosure, wherein the retainers are spaced apart from the enclosure.

22. The thermal appliance of claim 21, wherein the retainers are clips.

23. The thermal appliance of claim 21, wherein the retainers are made of a material with a low thermal conductivity.

24. The thermal appliance of claim 21, wherein a face of the insulating material has a top edge, a bottom edge, and two opposing side edges; wherein an axis extends along a length of the retainers; and wherein at least one of the retainers is positioned over the face of the insulating material such that the axis is not perpendicular to the top edge, the bottom edge, and the two opposing side edges.

25. The thermal appliance of claim 24, wherein a center of at least one of the retainers is positioned over a center of the face of the insulating material.

26. The thermal appliance of claim 21, wherein the inner surface and the outer surface of heating compartment are defined by a liner top, a liner bottom, a liner back, and two opposing liner sides; and wherein no retainers are provided at one or more of the liner top, the liner bottom, the liner back, and the liner sides.

27. A thermal appliance comprising:

an enclosure having an inner surface and an outer surface;

a heating compartment within the enclosure, the heating compartment having an inner surface and an outer surface;

insulating material disposed between the outer surface of the heating compartment and the inner surface of the enclosure such that an air gap is provided adjacent to a bottom surface of the insulating material; and a plurality of retainers attached to at least one of the heating compartment and the insulating material, wherein the retainers eliminate all air gaps between the insulating material and the outer surface of the heating compartment and prevent any portion of the insulating material from touching the inner surface of the enclosure, wherein the retainers are spaced apart from the enclosure, and wherein the retainers are clips that extend through the insulating material.

28. The thermal appliance of claim 27, wherein the retainers are made of a material with a low thermal conductivity.

29. The thermal appliance of claim 27, wherein a face of the insulating material has a top edge, a bottom edge, and two opposing side edges; wherein an axis extends along a length of the retainer; and wherein at least one of the retainers is positioned over the face of the insulating material such that the axis is not perpendicular to the top edge, the bottom edge, and the two opposing side edges.

30. The thermal appliance of claim 29, wherein a center of at least one of the retainers is positioned over a center of the face of the insulating material.

31. The thermal appliance of claim 27, wherein the inner surface and the outer surface of heating compartment are defined by a liner top, a liner bottom, a liner back, and two opposing liner sides; and wherein no retainers are provided at one or more of the liner top, the liner bottom, the liner back, and the liner sides.

* * * * *